US005395288A

United States Patent [19]

Linden et al.

[11] Patent Number: 5,395,288

[45] Date of Patent: * Mar. 7, 1995

[54] TWO-WAY-WRITE TYPE, SINGLE SHEET, SELF-REPLICATING FORMS

[76] Inventors: Gerald E. Linden, 882 Econlocknetchee Tr., Orlando, Fla. 32822; Keith E. Schubert, 4 Timothy Rd., W. Norwalk, Conn. 06850

[ * ] Notice: The portion of the term of this patent subsequent to Aug. 11, 2009 has been disclaimed.

[21] Appl. No.: 126,538

[22] Filed: Sep. 24, 1993

Related U.S. Application Data

[60] Division of Ser. No. 808,847, Dec. 16, 1991, Pat. No. 5,248,279, Ser. No. 591,781, Oct. 2, 1990, abandoned, Ser. No. 497,219, Mar. 22, 1990, Pat. No. 5,154,668, Ser. No. 494,565, Feb. 26, 1990, Pat. No. 5,137,494, Ser. No. 436,189, Nov. 13, 1989, Pat. No. 5,197,992, and Ser. No. 334,183, Apr. 6, 1989, Pat. No. 5,127,879, said Ser. No. 808,847, is a continuation-in-part of Ser. No. 723,690, Jun. 24, 1991, Pat. No. 5,135,437, which is a continuation of Ser. No. 484,686, Feb. 23, 1990, abandoned.

[51] Int. Cl.[6] ..... B41L 1/20

[52] U.S. Cl. ..... 462/18; 462/28; 462/39; 281/5

[58] Field of Search ..... 462/25, 28, 39, 18, 462/62, 7; 281/5, 2; 283/117

[56] References Cited

U.S. PATENT DOCUMENTS

| | | |
|---|---|---|
| Re. 30,041 | 7/1979 | Maalouf . |
| Re. 30,116 | 10/1979 | Maalouf . |
| Re. 31,695 | 10/1984 | Zink . |
| 371,126 | 10/1887 | Currie . |
| 396,560 | 1/1889 | Harrison et al. . |
| 418,455 | 12/1889 | Gray . |
| 419,359 | 1/1890 | Rogers . |
| 445,368 | 1/1891 | Campbell . |
| 664,384 | 12/1900 | Cooke . |
| 683,782 | 10/1901 | Morland . |

(List continued on next page.)

FOREIGN PATENT DOCUMENTS

| | | |
|---|---|---|
| 613658 | 3/1926 | France . |
| 549442 | 4/1932 | Germany . |
| 128558 | 2/1962 | New Zealand . |
| 128915 | 3/1964 | New Zealand . |
| 185282 | 11/1980 | New Zealand . |
| 1347807 | 2/1974 | United Kingdom . |
| 2085359 | 4/1982 | United Kingdom . |

OTHER PUBLICATIONS

Black Clawson Brochure.

"Flip-N-Rite", 7-page instructions by Gary Thompson.

Form Magazine, Feb., 1989, pp. 74–80.

Business Forms Labels & Systems, Jul. 1990, p. 48.

"Pressure Sensitive Papers", Project 2558, No. 222, Tappi Coating Committee, 1965. (copy filed previously)

"Pressure Sensitive Papers", Project 2558, Tappi Coating Committee, Dec., 1967. (copy filed previously).

Facsimiles of BH Medical, MAP Phone Message, Moore Two-Way Rite, St. Vincent Medical Center, Maybelline and Hartz Mountain Forms.

*Primary Examiner*—Frances Han

*Attorney, Agent, or Firm*—Gerald E. Linden

[57] ABSTRACT

Improvements and alternate embodiments for two-sided, self-replicating forms are described, Form sets having two single sheets, each sheet delineated into two panels, making three two-sided copies of a two-sided original are described with fully-coated carbonless coatings and with patterned carbonless coatings. A form set having two single sheets, each sheet delineated into two panels, making four two-sided copies, two of which have original writing on one surface, is described. A single sheet form, delineated into two panels, making two two-sided copies, each of which has original writing on one surface, is described. A single sheet form, delineated into an original and a copy panel, making a two-sided copy of an original having original writing on both surfaces is described. A form set having a single sheet delineated into an original un-coated panel and a CF-coated copy panel, and employing a separate CB-coated image-transferring sheet is described.

16 Claims, 16 Drawing Sheets

U.S. PATENT DOCUMENTS

| | | |
|---|---|---|
| 756,258 | 4/1904 | Mallin . |
| 765,408 | 7/1904 | Wildey . |
| 797,302 | 8/1905 | Meacham . |
| 897,783 | 9/1908 | Reynolds . |
| 971,283 | 9/1910 | Krueger . |
| 972,549 | 10/1910 | Lewis . |
| 1,101,262 | 6/1914 | Edmonds . |
| 1,187,682 | 6/1916 | Trueman . |
| 1,301,834 | 4/1919 | Gilman . |
| 1,392,748 | 10/1921 | Davidson . |
| 1,468,094 | 9/1923 | Wherry . |
| 1,873,997 | 8/1932 | Davis . |
| 1,980,318 | 11/1934 | Caton . |
| 1,980,319 | 11/1934 | Caton . |
| 2,006,034 | 6/1935 | Stevens . |
| 2,035,768 | 3/1936 | Sherman et al. . |
| 2,084,221 | 6/1937 | Schutz . |
| 2,093,086 | 9/1937 | Luzzatto . |
| 2,098,706 | 11/1937 | Lawson et al. . |
| 2,118,888 | 5/1938 | Lewis et al. . |
| 2,131,381 | 9/1938 | Linderman . |
| 2,148,886 | 2/1939 | Wanser . |
| 2,168,098 | 8/1939 | Groák . |
| 2,194,670 | 3/1940 | Neu . |
| 2,211,532 | 8/1940 | Biggs . |
| 2,220,842 | 11/1940 | Hano . |
| 2,226,722 | 12/1940 | Jones . |
| 2,257,766 | 10/1941 | Sherman . |
| 2,262,347 | 11/1941 | Sturc . |
| 2,264,119 | 11/1941 | Lichter . |
| 2,327,215 | 8/1943 | Potter . |
| 2,458,729 | 1/1949 | Politzer . |
| 2,470,586 | 5/1949 | Tathwell . |
| 2,503,680 | 4/1950 | Newman . |
| 2,548,366 | 4/1951 | Green et al. . |
| 2,550,466 | 4/1951 | Green et al. . |
| 2,550,468 | 4/1951 | Green et al. . |
| 2,550,469 | 4/1951 | Green et al. . |
| 2,606,775 | 8/1952 | Newman . |
| 2,618,573 | 11/1952 | Green . |
| 2,637,571 | 5/1953 | Tilly . |
| 2,694,429 | 11/1954 | Berger . |
| 2,712,507 | 7/1955 | Green . |
| 2,802,678 | 8/1957 | Bright . |
| 2,869,898 | 1/1959 | Martin . |
| 2,870,040 | 1/1959 | Gill . |
| 2,907,585 | 10/1959 | Sornberger . |
| 2,980,447 | 4/1961 | Weger . |
| 3,016,308 | 1/1962 | Macaulay . |
| 3,104,799 | 9/1963 | Steidinger . |
| 3,364,052 | 1/1968 | Martino . |
| 3,376,154 | 4/1968 | Campbell et al. . |
| 3,429,827 | 2/1969 | Ruus . |
| 3,481,759 | 12/1969 | Ostlie . |
| 3,539,375 | 11/1970 | Baum . |
| 3,625,547 | 12/1971 | Burke . |
| 3,682,681 | 8/1972 | Kunkel . |
| 3,769,057 | 10/1973 | Lin . |
| 3,769,062 | 10/1973 | Ishige et al. . |
| 3,825,467 | 7/1974 | Phillips, Jr. . |
| 3,854,654 | 12/1974 | Van Malderghem . |
| 3,902,655 | 9/1975 | Huffman . |
| 3,908,063 | 9/1975 | Rosendale et al. . |
| 3,945,870 | 3/1976 | Johnsen . |
| 3,955,750 | 5/1976 | Huffman . |
| 3,963,853 | 6/1976 | Hughes et al. . |
| 3,968,299 | 7/1976 | Angleman . |
| 3,981,523 | 9/1976 | Maalouf . |
| 3,988,971 | 11/1976 | Steidinger . |
| 3,996,406 | 12/1976 | Alsop . |
| 4,000,916 | 1/1977 | Lucas . |
| 4,036,511 | 7/1977 | Maalouf . |
| 4,039,046 | 7/1977 | D'Luhy . |
| 4,045,053 | 8/1977 | Carriere . |
| 4,046,404 | 9/1977 | Treier . |
| 4,056,191 | 11/1977 | Weisenfluh . |
| 4,062,567 | 12/1977 | Macaulay . |
| 4,063,754 | 12/1977 | Shackle et al. . |
| 4,081,127 | 3/1978 | Steidingr . |
| 4,081,188 | 3/1978 | Westcott . |
| 4,091,122 | 5/1978 | Davis et al. . |
| 4,095,695 | 6/1978 | Steidinger . |
| 4,097,619 | 6/1978 | Davis et al. . |
| 4,111,461 | 9/1978 | Levensalor . |
| 4,112,138 | 9/1978 | Davis et al. . |
| 4,113,281 | 9/1978 | Halse . |
| 4,121,857 | 10/1978 | Halse . |
| 4,126,334 | 11/1978 | Van Malderghem . |
| 4,137,343 | 1/1979 | Davis et al. . |
| 4,138,302 | 2/1979 | D'Luhy . |
| 4,139,218 | 2/1979 | Davis et al. . |
| 4,139,392 | 2/1979 | Davis et al. . |
| 4,143,890 | 3/1979 | Davis et al. . |
| 4,143,891 | 3/1979 | Neubauer . |
| 4,165,101 | 8/1979 | Sternberg . |
| 4,168,851 | 9/1979 | Halse . |
| 4,172,605 | 10/1979 | Welsch et al. . |
| 4,178,018 | 12/1979 | Halse . |
| 4,198,446 | 4/1980 | Goetz . |

(List continued on next page.)

U.S. PATENT DOCUMENTS 4,199,174 4/1980 Sornberger .
4,203,619 5/1980 Sanders .
4,208,460 6/1980 Knechtle et al. .
4,217,162 8/1980 Glanz et al. .
4,282,275 8/1981 Werner .
4,336,067 6/1982 Shackle et al. .
4,343,494 8/1982 Ehrhardt et al. .
4,352,855 10/1982 Hiraishi et al. .
4,354,449 10/1982 Zink .
4,361,108 11/1982 Robillard et al. .
4,381,120 4/1983 Golden .
4,397,483 8/1983 Hiraishi et al. .
4,407,524 10/1983 Trautlein .
4,425,386 1/1984 Chang .
4,448,445 5/1984 Chang et al. .
4,455,327 6/1984 Yoshida et al. .
4,501,559 2/1985 Griswold et al. .
4,512,595 4/1985 Breen .
4,533,160 8/1985 Malone .
4,556,390 12/1985 Rahn et al. .
4,566,720 1/1986 Goldman et al. .
4,576,399 3/1986 White et al. .
4,583,765 4/1986 Messinger .
4,593,935 6/1986 Kearns .
4,597,993 7/1986 Okada et al. .
4,614,362 9/1986 Breen et al. .
4,614,363 9/1986 Breen .
4,636,818 1/1987 Jerabek .
4,642,662 2/1987 Torii et al. .
4,657,783 4/1987 Tatt et al. .
4,690,433 9/1987 Showers et al. .
4,715,620 12/1987 Thompson .
4,722,553 2/1988 Evans .
4,740,015 4/1988 Caprio et al. .
4,745,097 5/1988 Maekawa et al. .
4,762,342 8/1988 Thompson .
4,814,319 3/1989 Matsumoto et al. .
4,846,594 7/1989 Riskin .
4,853,364 8/1989 Liang et al. .
4,859,561 8/1989 Metz et al. .
4,871,193 10/1989 Wörndli .
4,877,767 10/1989 Liang et al. .
4,912,080 3/1990 Weinstein .
4,935,401 6/1990 Pendergrass, Jr. .
4,938,507 7/1990 Ashby et al. .
4,947,343 7/1990 Amari .
4,957,380 9/1990 Gerstle et al. .
4,959,343 9/1990 Weinstein .
4,970,193 11/1990 Liang et al. .
4,974,035 11/1990 Rabb et al. .
4,977,060 12/1990 Liang et al. .
4,977,131 12/1990 Macaulay .
4,996,184 2/1991 Bevan et al. .
5,002,311 3/1991 Brunjes .
5,004,271 4/1991 Piatt .

TWO-WAY-WRITE TYPE, SINGLE SHEET, SELF-REPLICATING FORMS

CROSS-REFERENCE TO RELATED APPLICATIONS

This application is a division of copending U.S. patent application Ser. No. 07/808,847, filed Dec. 16, 1991 (now U.S. Pat. No. 5,248,279; Issued Sep. 28, 1993), which is a continuation-in-part of U.S. patent application Ser. No. 07/723,690, filed Jun. 24, 1991 (now U.S. Pat. No. 5,135,437; Issued Aug. 4, 1992), which is a continuation of U.S. patent application Ser. No. 07/484,686, filed Feb. 23, 1990 (now abandoned); and of U.S. patent application Ser. No. 07/591,781, filed Oct. 2, 1990 (now abandoned), which was continued as U.S. patent application Ser. No. 07/908,540, filed Jun. 29, 1992 (now U.S. Pat. No. 5,224,897; Issued Jul. 6, 1993); and of U.S. patent application Ser. No. 07/497,219, filed on Mar. 22, 1990 (now U.S. Pat. No. 5,154,668; Issued Oct. 13, 1992); and of U.S. patent application Ser. No. 07/494,565, filed on Feb. 26, 1990 (now U.S. Pat. No. 5,137,494; Issued Aug. 11, 1992); and of U.S. patent application Ser. No. 07/436,189, filed Nov. 13, 1989 (now U.S. Pat. No. 5,197,992; Issued Mar. 30, 1993); and of U.S. patent application Ser. No. 07/334,183, filed Apr. 6, 1989 (now U.S. Pat. No. 5,127,879; Issued Jul. 7, 1992).

TECHNICAL FIELD OF THE INVENTION

The invention relates to two-sided, self-replicating forms employing carbonless coatings for reproducing information entered on both sides of the form.

BACKGROUND OF THE INVENTION

Carbonless copy forms are well known. A typical two-part form includes a top sheet having a coated back (CB) containing microencapsulated (generally colorless) dye, and a bottom sheet having a coated front (CF) containing a reactive dye-revealing substance. The top and bottom sheets are assembled, such as by gluing, into a "manifold", or many part set, which typically has a "stub". The pressure of writing on the front surface of the top sheet ruptures the microcapsules on the CB-coated back surface of the top sheet, releasing dye onto the CF-coated front surface of the bottom sheet, whereupon the writing is revealed in a contrasting (visible) color on the front surface of the bottom sheet. "CB" and "CF" are "components" of a carbonless "system".

Multiple carbonless copies are produced in a similar manner. One or more intermediate sheets are assembled between the CB top and CF bottom sheets. Each intermediate sheet has a carbonless front (CF) coating on its front surface for revealing the dye from the previous sheet, and has a carbonless back (CB) coating on its back surface for releasing dye to the next sheet in the set. The intermediate sheets are termed "CFB" sheets.

With these techniques, one or more carbonless copies of information entered on the front surface of the original (top) sheet can be reproduced on the one side surface of the copy (intermediate and bottom) sheets.

The chemistry of the CB (image-transferring) and CF (image-revealing) coatings is well known, as are techniques for applying these coatings to paper stock. These coatings and techniques include various coatings applied to paper stock at the mill, as it is being produced, and coatings applied later (typically during the printing process) to plain paper stock. OPAS (On Press Application System) coatings offered by Mead Corporation are an example of the latter.

One well known variation of the two part CB/CF chemistry is the "Self-Contained" ("SC") coating. The SC coating is essentially a mixture of CB and CF, and is applied to the front surface of an underlying sheet for autogenously revealing an image of writing on the front surface of an overlying, un-coated sheet.

Another coating is a "transfer-onto-plain-paper" coating, wherein the back side of the overlying sheet is coated and the front surface of the underlying sheet is not coated. Since this type of coating functions in conjunction with plain paper, in an autogenous manner similar to SC, but is applied to the overlying versus underlying sheet, it can be termed "anti-SC". U.S. Pat. No. 4,352,855 discloses such a "transfer-onto-plain-paper" coating.

A variation of the single-sided carbonless form is found in so-called "two-way-write" systems. One such example is found in U.S. Pat. No. 4,000,916, issued to Lucas, which describes a manifold report form having three superimposed record sheets (top, middle and bottom). Carbon sheets and protective sheets are arranged between the record sheets. Information entered on the front surface of the top record sheet is reproduced on the front surfaces of the middle and bottom sheets. The form is then flipped over, in its entirety, and various carbon and protective sheets are removed. Information entered on the back surface of the bottom sheet is reproduced on the back surface of the middle and top sheets. Other examples of two-way-write systems are found in U.S. Pat. No. 4,165,101 (Sternberg), and in U.K. Publication No. 2,085,359 (Johnsen).

With such two-way-write systems, a "true-original" is not created. Rather, each of the top and bottom sheets contains "original" (e.g., hand written) information on only one surface, and "copy" (reproduced by carbon paper or the CB/CF dye reaction) information on the other surface. This feature of two-way rite systems is acceptable in instances where a "true" two-sided original is not required.

For a "true-original", two-sided self-replicating form, the top sheet would have original writing on both sides, and additional sheets would have copy images in both sides. A "true-original" is often required in legal documents, and the like.

An early example of a true-original system is found in U.S. Pat. No. 2,802,678 (Bright; 1957), wherein several sheets, interleaved carbon papers and interleaved guard sheets are employed. This patent also discloses an alternate configuration of the sheets wherein a "two-way-write" manifold assembly is produced.

Another example of a true-original system is U.S. Pat. Nos. 3,981,523, 4,036,511, RE 30,041 and RE 30,116 (Maalouf), which employ separate, non-manifolded carbonless-coated sheets.

Another example of a true-original type system is found in U.S. Pat. No. 4,126,334 (Van Malderghem), which discloses a manifold assembly of three sheets. Information is entered on one side of a top sheet, and is imaged onto corresponding one sides of an intermediate and bottom sheet. The intermediate sheet is removed from the assembly, the top sheet is flipped over, and information entered on the opposite side of the top sheet is imaged onto the corresponding opposite side of the bottom sheet.

Additional examples of "two-way-write" and "true-original" manifold form assemblies are found in U.S. Pat. Nos. 4,715,620 and 4,762,342, issued to Thompson. As with Van malderghem, the examples set forth in the Thompson patents are also manifold assemblies, and rely on flipping the top sheet over a stub for entering information on the opposite side of the top sheet.

Some problems with any of the techniques of employing a manifold form assembly for either "two-way-write" or "true-original" systems is that 1) if the top sheet is to be repositioned, it is extremely difficult to maintain registration (alignment) when a stub of any kind is involved; 2) they are generally formed of many sheets of different paper stock, and require collating and assembling at the end of the production line; and 3) they are generally not very user-friendly.

Copending U.S. patent application Ser. No. 334,183 (Attorney Docket No. 88-126), filed on Apr. 6, 1989 by Keith E. Schubert discloses the "genesis" of true-original two-sided (or duplex) copying of both sides of an original form, wherein an original portion of a single folded sheet has information entered, such as by pen, on both sides thereof, which information is replicated on both sides of a copy portion of the folded sheet. An important feature of the disclosed structure is that the original and copy portions, or panels, are formed from a single sheet of paper, rather than from several sheets assembled into a manifold.

Copending U.S. patent application Ser. No. 436,189 (Attorney Docket No. 89-109), filed on Nov. 13, 1989 by Keith E. Schubert discloses further techniques for effecting true-original two-sided copying using carbonless coatings, discloses techniques for "patterning" the carbonless coatings, and discloses techniques for making more than one copy of information entered on both sides of an original.

U.S. patent application Ser. No. 484,686 (Attorney Docket No. 90-128), filed Feb. 23, 1990 (now abandoned), and its continuation U.S. patent application Ser. No. 723,690 (Attorney Docket No. 90-128-1), filed Jun. 24, 1991 by Keith E. Schubert, discloses a true-original technique wherein a single sheet is divided into three panels: an original panel which is void of any carbonless coating; a copy panel which is coated with carbonless CF (image revealing) on both sides; and an intermediate transfer panel which is coated with carbonless CB (image transferring) on both sides. The intermediate image-transferring panel, which may also be a separate sheet, may be discarded after use, since it is used solely for image transferring.

Copending U.S. patent application Ser. No. 494,565 (Attorney Docket No. 90-127), filed on Feb. 26, 1990 (improperly recorded by the Patent Office) by Keith E. Schubert and Gerald E. Linden discloses various techniques of patterning coatings on a single sheet of paper to avoid writing in coated areas. Again, the structure is directed to a true-original system.

Copending U.S. patent application Ser. No. 497,219 (Attorney Docket No. 90-136), filed on Mar. 22, 1990 by Keith E. Schubert and Gerald E. Linden discloses true-original techniques for making two copies of information entered on both sides of an original, without patterning, employing two dissimilar (mutually non-reactive) carbonless systems.

Copending U.S. patent application Ser. No. 591,781 (Attorney Docket No. 90-138), filed on Oct. 2, 1990 by Keith E. Schubert and Gerald E. Linden discloses various improvements to single sheet true-original forms, including making the copy panel larger (e.g., wider), and forming the single sheet as a laminated structure. Techniques for fabricating the form from two initially separate sheets are also disclosed therein.

Generally, these copending applications are directed solely to true-original systems, and for the most part are directed to the making of a single copy. There remains a need to address the requirements of a two-way-write system, while preserving the single sheet concept. There also remains a need for further alternate configurations for making two or more copies, while generally preserving the single sheet concept.

DISCLOSURE OF THE INVENTION

It is a general object of the present invention to provide improvements in self-replicating duplex forms.

It is a further object of the invention to provide a single sheet, non-manifolded, two-way-write system.

It is a further object of the invention to provide improved techniques for making two or more copies in either a true-original or two-way-write system.

BRIEF SUMMARY OF PARENT CASES

By way of summary, according to the inventions disclosed in the parent cases, a single sheet of paper is delineated by one or more perforated fold lines into two or more panels (portions), one panel which serves as an "original" panel for entering information on both sides thereof, another panel which serves as a "copy" panel for reproducing the information entered on both the front and back surfaces of the original panel, and a third panel (if any) which produces either a second two-sided copy or is simply an image-transferring panel. Various coating schemes are disclosed, including substantially fully coating each face (surface) of the panels and coating only selected areas on the panels ("patterning"). Several other features are disclosed, such as making the copy panel larger (wider) than the original panel.

Group 1—Two Folded/Nested Sheets, Multiple Copies, True Original

According to the invention, a first single sheet of paper is delineated to have a "first" original panel and a "second" copy panel. A second, similar sheet of paper is delineated to have a third copy panel and a fourth copy panel.

Both sheets are folded one way, and the second sheet is interposed ("nested") between the panels of the first sheet. The sheets are appropriately carbonless coated so that information entered on one surface of the first original panel is imaged onto a corresponding one surface of the underlying third copy panel, then onto a corresponding one surface of the next underlying fourth copy panel, then onto a corresponding one surface of the next underlying second copy panel.

Both sheets are re-folded, another way, and the second sheet is re-interposed between the panels of the first sheet. The sheets are appropriately carbonless coated so that information entered on the opposite surface of the first original panel is imaged onto a corresponding opposite surface of the underlying third copy panel, then onto a corresponding opposite surface of the next underlying fourth copy panel, then onto a corresponding opposite surface of the next underlying second copy panel.

In this manner, two two-panel sheets are employed, and three two-sided copies of a two-sided true-original are produced.

Embodiments using carbonless coatings covering substantially the entire surfaces of the panels ("fully-coated") and only selected areas of the panels ("patterned") are disclosed.

Group 2—Two Folded/Nested Sheets, Two-Way-Write

According to the invention, a first single sheet of paper is delineated to have a "first" panel and a "second" panel. A second, similar sheet of paper is delineated to have a "third" panel and a "fourth" panel.

Both sheets are folded, and the second sheet is interposed (nested) between the panels of the first sheet. The sheets are appropriately carbonless coated so that information entered on one surface of the uppermost first panel is imaged onto a corresponding one surface of the underlying third panel, then onto a corresponding one surface of the next underlying fourth panel, then onto a corresponding one surface of the next underlying second panel.

The sheets are repositioned as a whole (they are not re-folded), so that the opposite surface of the second panel is uppermost, and are appropriately carbonless coated so that information entered on the opposite surface of the second panel is imaged onto a corresponding opposite surface of the underlying fourth panel, then onto a corresponding opposite surface of the next underlying third panel, then onto a corresponding opposite surface of the next underlying first panel.

In this manner, two two-panel sheets are employed, and while none of the panels has original writing on both sides, four instances of a two-sided document are produced.

Group 3—One Folded Sheet, Two-Way-Write

According to the invention, a single sheet of paper is delineated to have a "first" panel and a "second" panel.

The sheet is folded, and appropriately carbonless coated so that information entered on one surface of the uppermost first panel is imaged onto a corresponding one surface of the underlying second panel.

The sheet is repositioned as a whole (it is not re-folded), so that the opposite surface of the second panel is exposed for writing, and is appropriately carbonless coated so that information entered on the opposite surface of the second panel is imaged onto the corresponding opposite surface of the first panel.

In this manner, while none of the panels has original writing on both sides, two instances of a two-sided document are produced.

Group 4—Folded Sheet, Transfer-Onto-Plain-Paper, True-Original

It has previously been disclosed that the copy panel can be coated with a "self-contained" ("SC") type carbonless coating, so that the original panel does not need to be carbonless coated.

According to the invention, a single sheet of paper is delineated into two panels, an original panel and a copy panel. The original panel is coated with a transfer-onto-plain-paper type carbonless coating (hereinafter "anti-SC" coating), and the copy panel is un-coated. In a case where the anti-SC coating is not endorsable, it is applied to the original panel in a patterned configuration (i.e., offset from front-to-back, so that writing areas are not coated).

In this manner, with the sheet folded one way, information entered on one surface of the original panel is imaged onto a corresponding one surface of the copy panel. With the sheet folded another opposite way, information entered on the opposite surface of the original panel is imaged onto a corresponding opposite surface of the copy panel.

Group 5—Two-Color Imaging, True-Original

According to the present invention, a single sheet of paper is delineated into an original and a copy panel. The original panel is un-coated, and the copy panel is provided with an image-receiving carbonless coating.

The sheet is folded one way, and a separate sheet of paper having an image-transferring carbonless coating is interposed between the original and copy panels so that information entered on one surface of the original panel is imaged onto a corresponding one surface of the copy panel.

The sheet is folded the other way, and the separate (or another separate) image-transferring sheet is re-inserted between the original and copy panels so that information entered onto the opposite surface of the original panel is imaged onto the corresponding opposite surface of the copy panel.

This particular embodiment of the invention resides in coating the copy panel with a carbonless coating (CF) that is capable of revealing an image in either of two colors (e.g., blue or black), and in selecting from two differently-coated image-transferring sheets that are coated with one of two image-transferring coatings (i.e., CB or CB') that will cause an image to reveal itself on the copy panel in a selected one of the two possible colors.

Alternatively, a single image-transferring sheet is employed, having a one color image-transferring coating (i.e., CB') on its one surface and another color image-transferring coating (i.e., CB) on its opposite surface.

Group 6—"Leftovers"

According to the present invention, there are various form constructions and methods of use that were non-elected for one reason or another in various of the parent cases. They are represented herein, for further prosecution.

Other objects, features and advantages of the invention will become apparent in light of the following description thereof.

Generally, throughout the descriptions that follow, a sheet of paper (designated #11, where "#" is 100, 200, 300, etc.) has a front surface (#12) and a back surface (#14) and is divided by a perforated fold line (#20) into two "panels"—an "original" panel (#16) for entering information on both sides thereof, and a "copy" panel (#18) for replicating information on both sides thereof. Each of the panels has two surfaces, a "one" surface (designated by an "a" suffix) and an "opposite" surface (designated by a "b" suffix). However, it should be realized that a particular surface of the multi-panel sheet may comprise contiguous "a" and "b" surfaces of various panels.

It should be understood that the concept of a single sheet of paper is not limited to single sheets, per se, but also includes paper produced on a roll which is typically cut into single sheets either before or after printing. Nevertheless, it is important to realize that a single sheet having two or more panels is entirely different than a manifold assembly having two or more sheets joined together by a stub (usually staples or glue).

DETAILED DESCRIPTION OF THE INVENTION

Group 1

True-Original, Multiple Copies

Figure 1A:
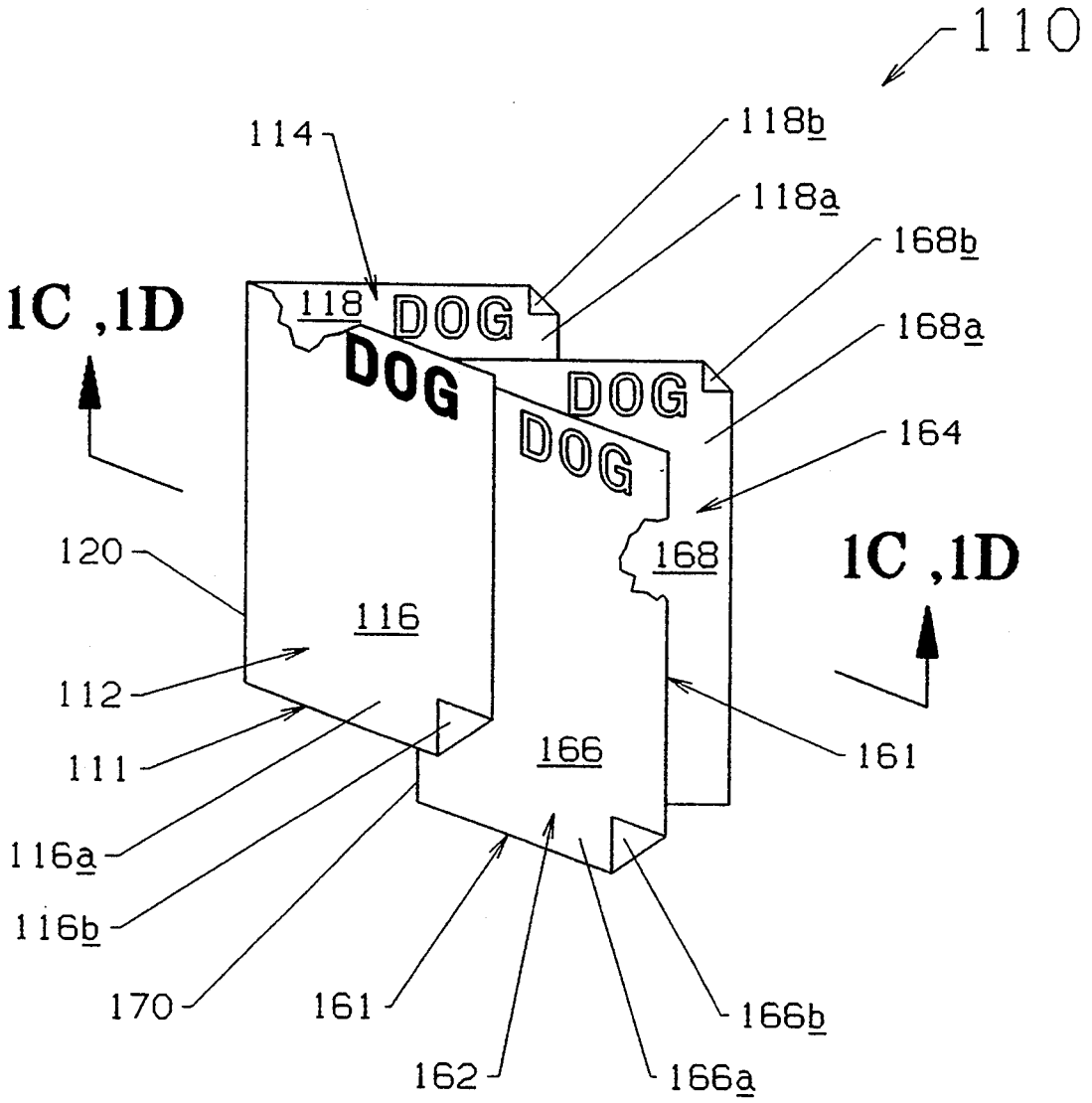
FIG. 1A is a perspective view of a "true-original" type, two-sided, self-replicating form set, with the individual elements folded one way, for entering information on one surface of the original panel.
Figure 1B:
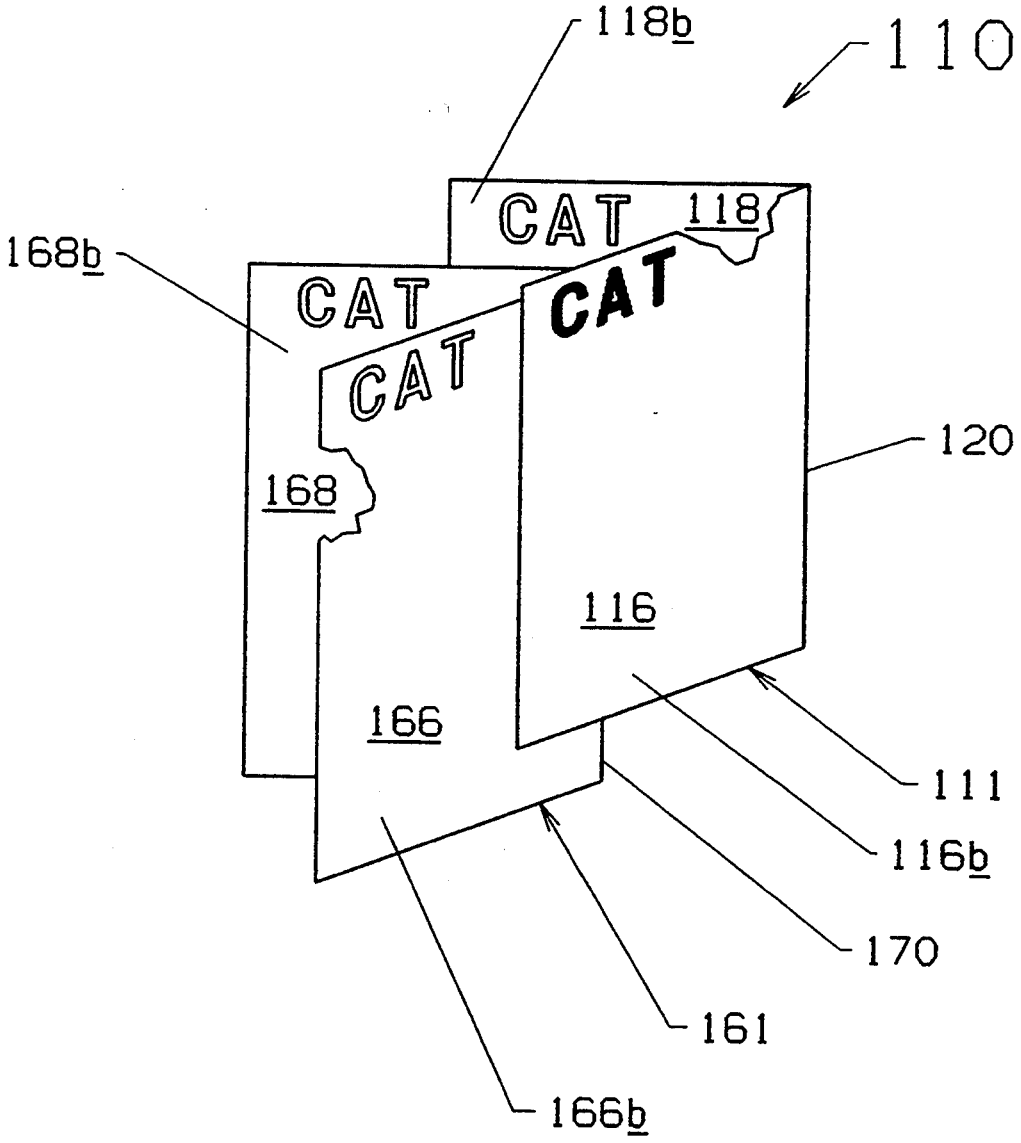
FIG. 1B is a perspective view of the form set of FIG. 1A, folded another way, for entering information on the opposite surface of the original panel.

FIGS. 1A and 1B show a two-sided, self-replicating form 110, capable of making multiple two-sided copies of a true, two-sided original.

A first sheet of paper 111 has a front surface 112 and a back surface 114. The sheet 111 is delineated into a "first" original panel 116 and a "second" copy panel 118, preferably by a fold 120, and the fold 120 is preferably provided with a series of perforations (not shown) for aiding in folding and facilitating separating (after use) the two panels 116, 118.

A second sheet of paper 161 has a front surface 162 and a back surface 164. The sheet 161 is delineated into a "third" copy panel 166 and a "fourth" copy panel 168. The delineation in the second sheet 161 is preferably folded 170 and perforated in a manner similar to the first sheet. The panels 116, 118, 166 and 168 are all nominally the same size, e.g. measuring $8\frac{1}{2} \times 11$ inches. However, as disclosed in parent U.S. patent application Ser. No. 591,781 (Attorney Docket 90-138), the second copy panel 118 advantageously can be made slightly larger (e.g., wider) than the first original panel 116. The fourth copy panel may also be larger than the third copy panel, in like manner.

In FIG. 1A, the sheet 111 is shown folded one way, and the sheet 161 is shown folded a corresponding one way, and the folded sheet 161 is inserted between the panels of the folded sheet 111. The Figure shows the folded sheet 161 being inserted between the panels of the sheet 111. With carbonless coatings appropriately disposed on the surfaces of the various panels, discussed below, information ("DOG") entered on one surface **116*a* of the first original panel 116 ("DOG", in solid lettering) will be imaged onto a corresponding one surface 166*a* of the third copy panel 166 ("DOG", in outline lettering) will further be imaged onto a corresponding one surface 168*a* of the fourth copy panel 168 ("DOG", in outline lettering), and will yet further be imaged onto a corresponding one surface 118*a* of the second copy panel 118 ("DOG", in outline lettering). The second sheet 161 is fully inserted (nested between the panels of the folded first sheet) so that its fold 170 is "snugged up" against the fold 120 of the first sheet 111**, to maintain proper alignment of the various panels, thereby ensuring that information entered at a particular location on the original is imaged onto a corresponding particular location on the copy panels.

In FIG. 1B, the sheet 111 is shown re-folded another, opposite way, so that the opposite surface **116*b* of the first original panel 116 is exposed for writing. The sheet 161 is also re-folded a corresponding opposite way, and the folded sheet 161 in inserted between the panels of the folded sheet 111. With appropriate carbonless coatings, discussed below, information ("CAT") entered on the opposite surface 116*b* of the first original panel 116 ("CAT", in outline lettering) will be imaged onto the corresponding opposite surface 166*b* of the third copy panel 166 ("CAT", in outline lettering) will further be imaged onto the corresponding opposite surface 168*b* of the fourth copy panel 168 ("CAT", in phantom), and will yet further be imaged onto the corresponding opposite surface 118*b* of the second copy panel 118 ("CAT", in phantom). Again, the second sheet 161 is fully inserted so that its fold 170 is "snugged up" against the fold 120 of the first sheet 111**, to maintain proper alignment of the various panels.

Before discussing how the various panels are carbonless coated, it should be noted that the front surface 112 of the overall sheet 111 comprises the one surface **116*a* of the first original panel 116 and the contiguous opposite surface 118*b* of the second copy panel 118. Similarly, the back surface 114 of the sheet 111 comprises the opposite surface 116*b* of the first original panel 116 and the contiguous one surface 118*a* of the second copy panel 118. Likewise, the front surface 162 of the sheet 161 comprises the one surface 166*a* of the third copy panel 166 and the contiguous opposite surface 168*b* of the fourth copy panel 168, and the back surface 164 of the sheet 161 comprises the opposite surface 166*b* of the third copy panel 166 and the contiguous one surface 168***a* of the fourth copy panel 168. This is a different way of calling out the parts than has been used previously (i.e., in the parent cases). Generally, in the parent cases, the front/back surfaces of the overall sheet were given descriptive prominence, and we had front (i.e., of the original panel) to back (i.e., of the copy panel) imaging. Herein, the one/opposite surfaces of the various panels are given descriptive prominence, and the one surface to one surface convention is adopted. Irrespective of whether the surfaces of the overall sheet or of the individual panels are given descriptive prominence, the form functions just the same.

Fully-Coated

Figure 1C:
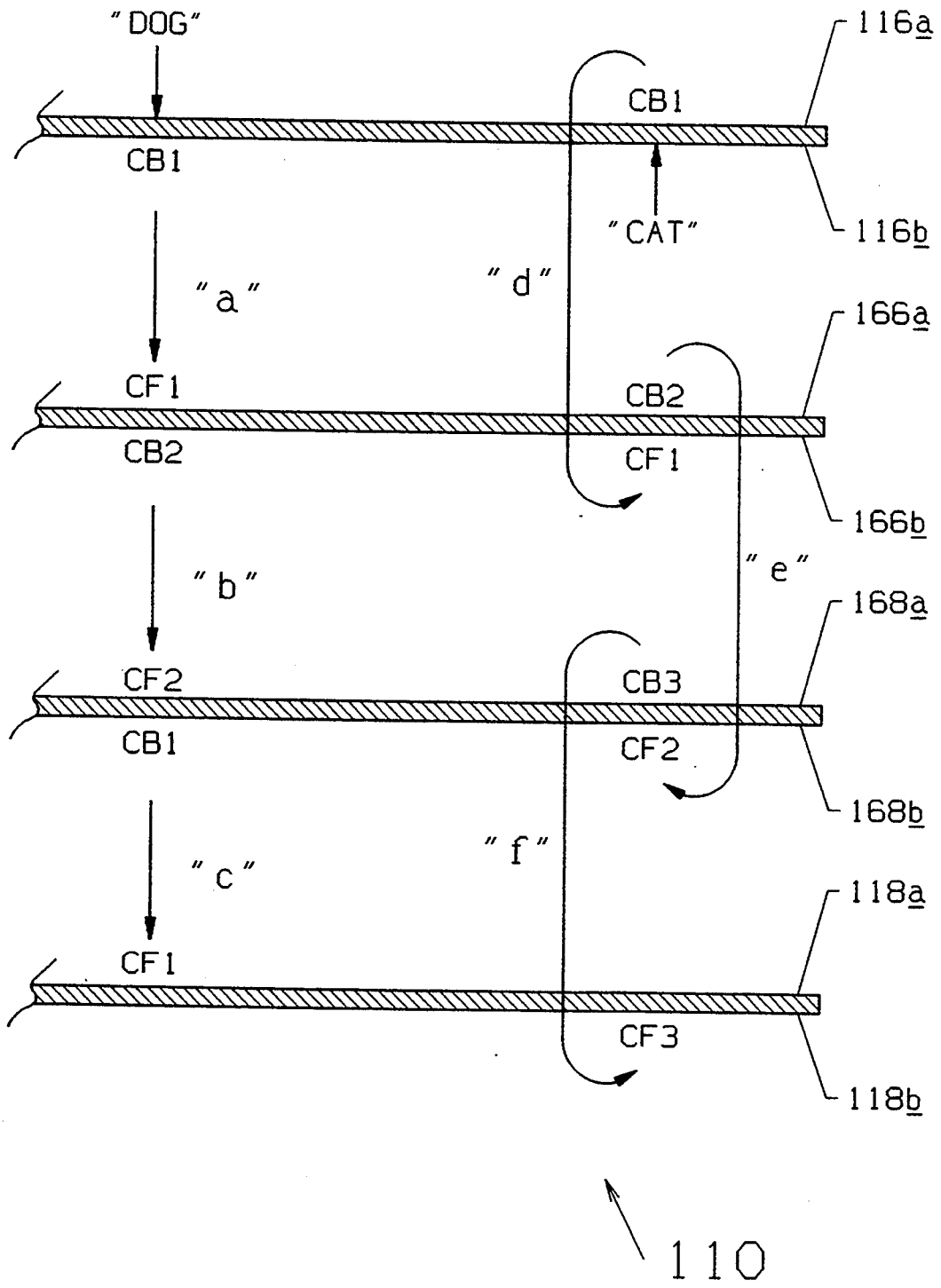
FIG. 1C is a cross-sectional view of the Form set of FIGS. 1A and 1B, showing a "fully-coated" embodiment of carbonless coatings.

FIG. 1C shows one embodiment of carbonless coating the sheets 111 and 161. The cross-section is "exploded", in the sense that the single sheet nature of the sheets 111 and 161 is not shown, nor are the folds 120 and 170 illustrated.

In this embodiment, the panels are "fully coated", and information can be entered at any location on either surface of the original panel 116, and will be reproduced at corresponding locations on corresponding surfaces of the copy panels.

The opposite surface 116*b* of the first original panel 116 is coated over substantially its entire area with a carbonless CB image-transferring coating selected from a first reactive system (hereinafter "CB1"). The one surface 166*a* of the third copy panel 166 is coated with a carbonless CF image-revealing coating selected from the first reactive system (hereinafter "CF1"), so that first information ("DOG") entered on the one surface 116*a* of the original panel 116 will be imaged by the CB1 coating on the opposite surface 116*b* of the original panel 116 onto the CF1-coated one surface 166*a* of the third copy panel 166. See arrow "a".

The opposite surface 166*b* of the third copy panel 166 is coated over substantially its entire area with a "CB2" coating, selected from a second carbonless system that is non-reactive with the first carbonless system. The one surface 168*a* of the fourth copy panel 168 is coated over substantially its entire area with a "CF2" coating from the second carbonless system, so that writing on the one surface 116*a* of the original panel 116 will further be imaged onto the one surface 168*a* of the fourth copy panel 168. See arrow "b".

The opposite surface 168*b* of the fourth copy panel 168 is coated over substantially its entire area with a CB1 coating, and the one surface 118*a* of the second copy panel 118 is coated over substantially its entire area with a CF1 coating, so that writing on the one surface 116*a* of the original panel 116 will further be imaged onto the one surface 118*a* of the second copy panel 118. See arrow "c".

Two mutually non-reactive carbonless systems are discussed in parent U.S. patent application Ser. No. 497,219. One system comprises CB1 and CF1, which react with one another. A second system comprises CF2 and CB2, which react with one another. By definition, CB1 does not react with CF2, and CB2 does not react with CF1. As will be evident from the following discussion, a third carbonless system comprising CB3 and CF3 is employed, and is at least partially mutually non-reactive with the first and second carbonless systems. As will become evident, it is important that the CB3 component of the third carbonless system does not react with either of CF1 or CF2. However, it is immaterial whether the CF3 component reacts with either of CB1 or CB2, since the disclosed form construction does not require that the CF3 and either of CB1 or CB2 components are both disposed (mixed) on the same surface of a panel or brought into contact with one another by the intimate contact of two panels.

As mentioned above, for entering second information ("CAT") in the other direction, namely from the opposite surface 116*b* of the first original panel 116 to the opposite surfaces 166*b*, 168*b* and 118*b* of the third, fourth and second copy panels 166, 168 and 118, respectively, the panels are re-folded, and the second sheet 161 is re-inserted between the panels of the first sheet 111. The sheets 111 and 161 are carbonless coated as follows.

The one surface 116*a* of the original panel 116 is coated over substantially its entire area with a CB1 component of the first carbonless system. The opposite surface 166*b* of the third copy panel 166 is coated with a CF1 component from the first carbonless system. In this manner, writing on the opposite surface 116*b* of the original panel 116 will be imaged by the CB1 coating on the one surface 116*a* of the original panel 116 onto the opposite surface 166*b* of the third copy panel 166. See arrow "d".

It should be noted that the surfaces of the third copy panel 166 are coated with a mixture of CB2 and CF1. These two carbonless system components (CB2 and CF1) are mixed and applied in a manner similar to self-contained ("SC") coatings, but they do not react with one another. Again, reference is made to parent U.S. patent application Ser. No. 497,219.

The one surface 166*a* of the third copy panel 166 is coated over substantially its entire area with a CB2 component, and the opposite surface 168*b* of the fourth copy panel 168 is coated over substantially its entire area with a CF2 component, so that writing on the opposite surface 116*b* of the original panel 116 will further be imaged onto the opposite surface 168*b* of the fourth copy panel 168. See arrow "e". Again, the CF2 and CB1 components can be mixed in a manner similar to an SC coating, but they will not autogenously react with one another.

The one surface 168*a* of the fourth copy panel 168 is coated over substantially its entire area with a CB3 component from a third carbonless system. The CB3 component is not reactive with the CF1 and CF2 components of the first and second carbonless systems, respectively. The opposite surface 118*b* of the second copy panel 118 is coated over substantially its entire area with a CF3 coating, reactive with the CB3 component, so that writing on the opposite surface 116*b* of the original panel 116 will further be imaged onto the opposite surface 118*b* of the second copy panel 118. See arrow "f".

Patterned Coatings

In the event that the CB coatings on the original panel 116 are not endorsable, and exhibit a tendency to cause pen-skipping, it is also possible to pattern the coatings on the original and copy panels. As will be seen in the description of FIG. 1D, below, this eliminates coatings from selected writing areas on the original panel 116 where information will be entered—while retaining coatings in selected coating areas behind the selected writing areas.

Figure 1D:
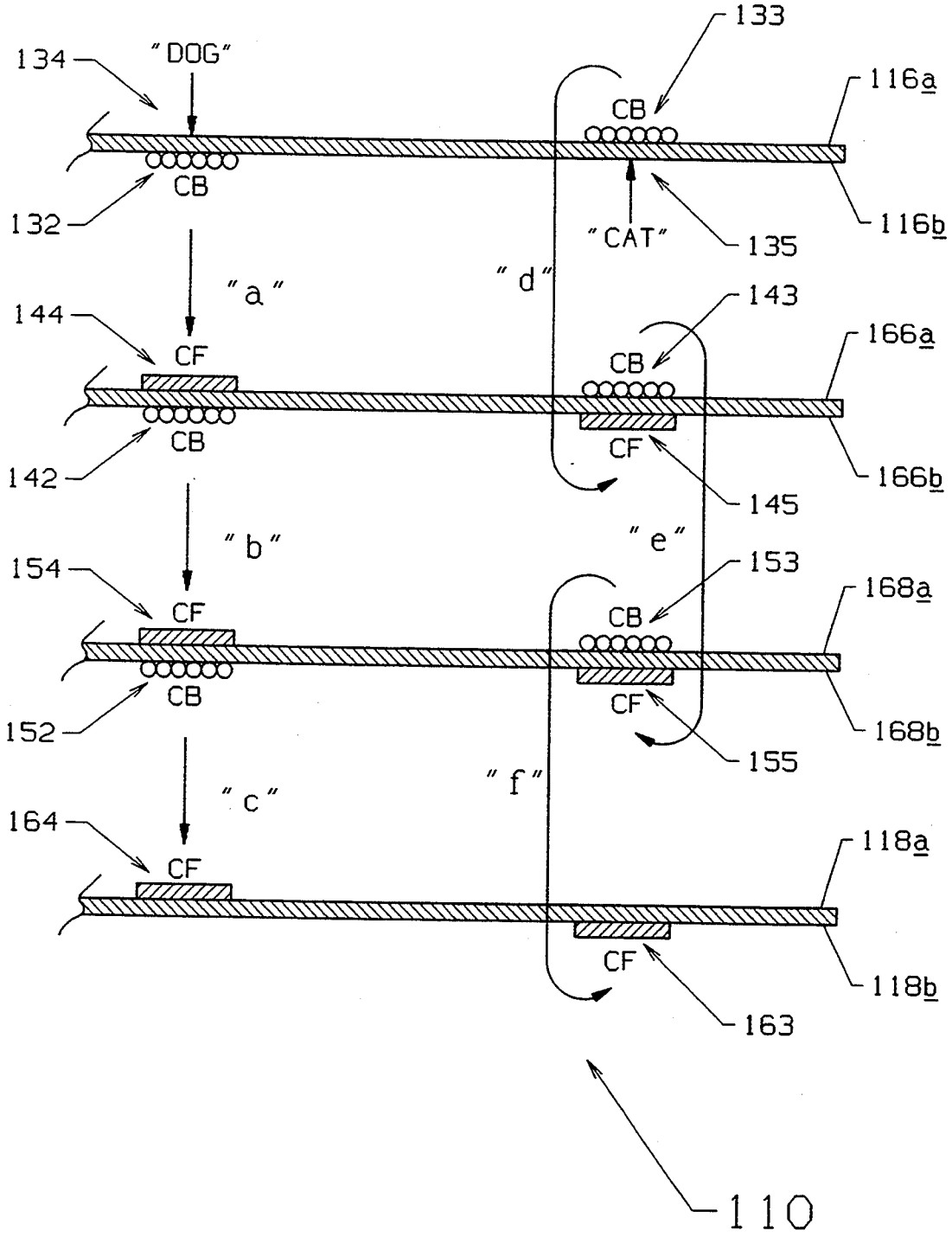
FIG. 1D is a cross-sectional view of the Form set of FIGS. 1A and 1B, showing a patterned embodiment of carbonless coatings.

FIG. 1D shows the form 110 of FIGS. 1A and 1B with patterned carbonless coatings. CB and CF components from a single carbonless system are employed.

A carbonless CB component is applied to a selected coating area 132 on the opposite surface 116*b* of the original panel 116 which is directly behind a selected writing area 134 on the one surface 116*a* of the original panel 116. A carbonless CF component is applied to a selected area 144 on the one surface 166*a* of the second copy panel 166, for revealing an image of first information ("DOG") entered upon the selected writing area 134. See arrow "a". The area 144 is aligned with the area 134.

A carbonless CB component is applied to a selected coating area 142 on the opposite surface 166*b* of the third copy panel 166 which is directly behind the selected area 144. A carbonless CF component is applied to a selected area 154 on the one surface 168*a* of the fourth copy panel 168, for revealing an image of writing ("DOG") impressed upon the selected writing area 134. See arrow "b". The area 154 is aligned with the areas 134, 132, 144 and 142.

A carbonless CB component is applied to a selected coating area 152 on the opposite surface 168*b* of the fourth copy panel 168 which is directly behind the selected area 154. A carbonless CF component is applied to a selected area 164 on the one surface 118*a* of the second copy panel 118, for revealing an image of writing ("DOG") impressed upon the selected writing area 134. See arrow "c". The area 164 is aligned with the areas 134, 132, 144, 142, 154 and 152.

The selected areas 134, 132, 144, 142, 154, 152 and 164 comprise only a portion of the respective panel surfaces, and may be one contiguous area or a plurality of non-contiguous areas. As will be seen, the remaining areas on the surfaces of the panels are "reserved" for imaging in the opposite direction.

As mentioned above (FIGS. 1A and 1B), the sheets are re-folded and re-inserted for entering second information ("CAT") on the opposite surface 116*b* of the original panel 116, and reproducing the second information on corresponding opposite surfaces of the copy panels.

A carbonless CB component is applied to a selected coating area 133 on the one surface 116*a* of the original panel 116 which is directly behind a selected writing area 135 on the opposite surface 116*b* of the original panel 116. A carbonless CF component is applied to a selected coating area 145 on the opposite surface 166*b* of the third copy panel 166, for revealing an image of writing ("CAT") impressed upon the selected writing area 135. See arrow "d". The area 145 is aligned with the area 133.

A carbonless CB component is applied to a selected coating area 143 on the one surface 166*a* of the third copy panel 166 which is directly behind the selected area 145. A carbonless CF component is applied to a selected area 155 on the opposite surface 168*b* of the fourth copy panel 168, for revealing an image of writing ("CAT") impressed upon the selected writing area 135. See arrow "e". The area 155 is aligned with the areas 135, 133, 145 and 143.

A carbonless CB component is applied to a selected coating area 153 on the one surface 168*a* of the fourth copy panel 168 which is directly behind the selected area 155. A carbonless CF component is applied to a selected area 163 on the opposite surface 118*b* of the second copy panel 118, for revealing an image of writing ("CAT") impressed upon the selected writing area 135. See arrow "f". The area 163 is aligned with the areas 135, 133, 145, 143, 155 and 153.

The first selected areas 134, 132, 144, 142, 154, 152 and 164 are "offset", or non-aligned front-to-back, on a per panel basis with the second selected areas 135, 133, 145, 143, 155, 153 and 163.

Group 2

"Two-Way-Write" with multiple copies

While the form 110, described hereinabove, creates a "true-original" having original writing on both sides of the original panel, it is evidently somewhat complex to use. For example, if the second sheet 161 is not re-folded and inserted correctly between the panels of the re-folded first sheet 111, the desired result may not be achieved. Hence, it is useful to create a form having two interleaved (nested) folded single sheets that is easier to use. As will be seen in the description that follows, the result is a "two-way-write" type form, wherein none of the panels have original writing on both sides. Hence, the term "original" panel is not employed. Rather, the terms "first", "second", "third" and "fourth" panels are employed. But for the arrangement of carbonless coatings, and the way in which the form is used, the basic construction of the form set 200 is very similar to the form set 100 of FIGS. 1A, 1B and 1D.

Figure 2A:
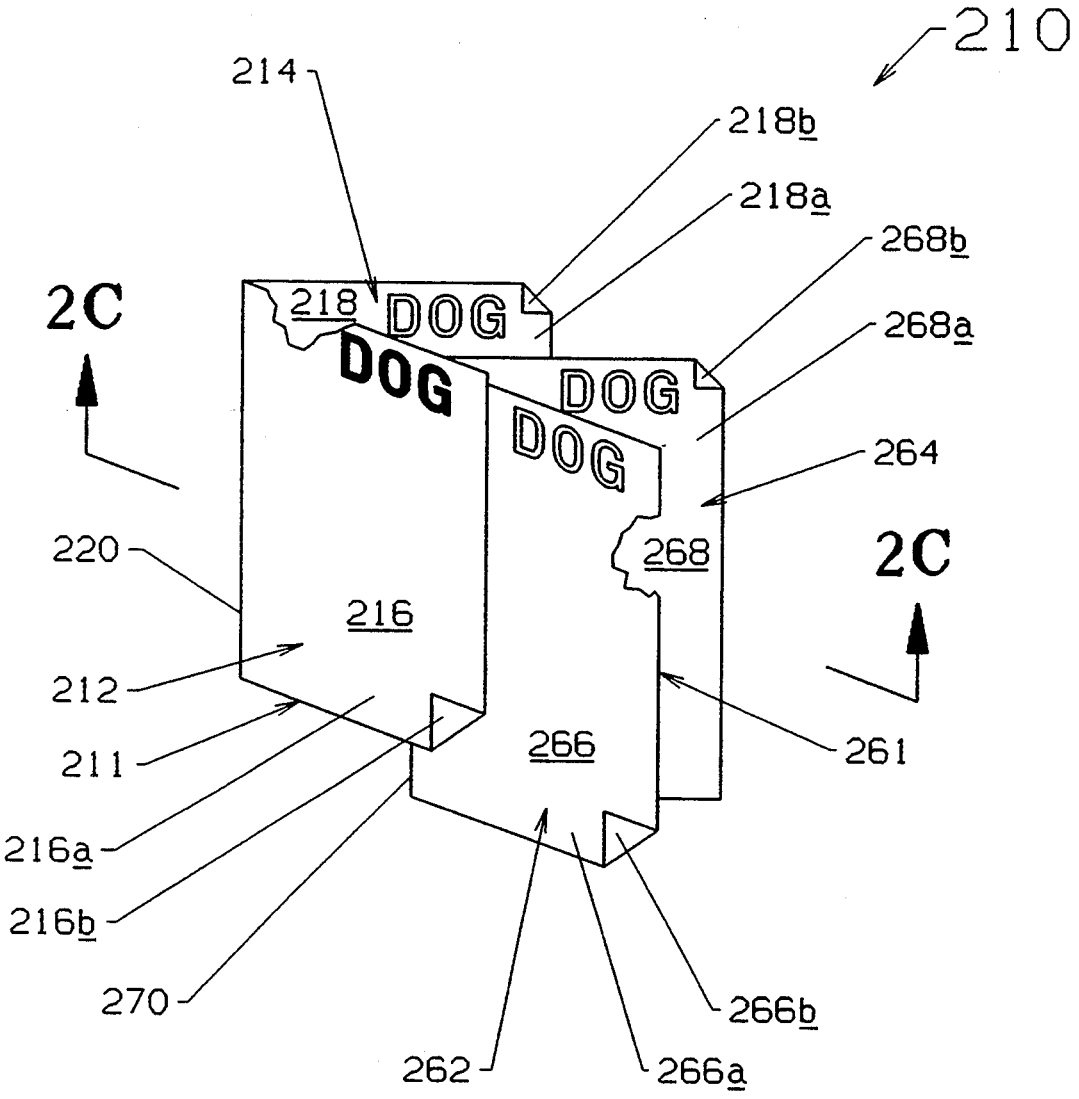
FIG. 2A is a perspective view of a "two-way-write" type two-sided, self-replicating form set, with the individual elements folded one way, for entering information on one surface of the original panel.
Figure 2B:
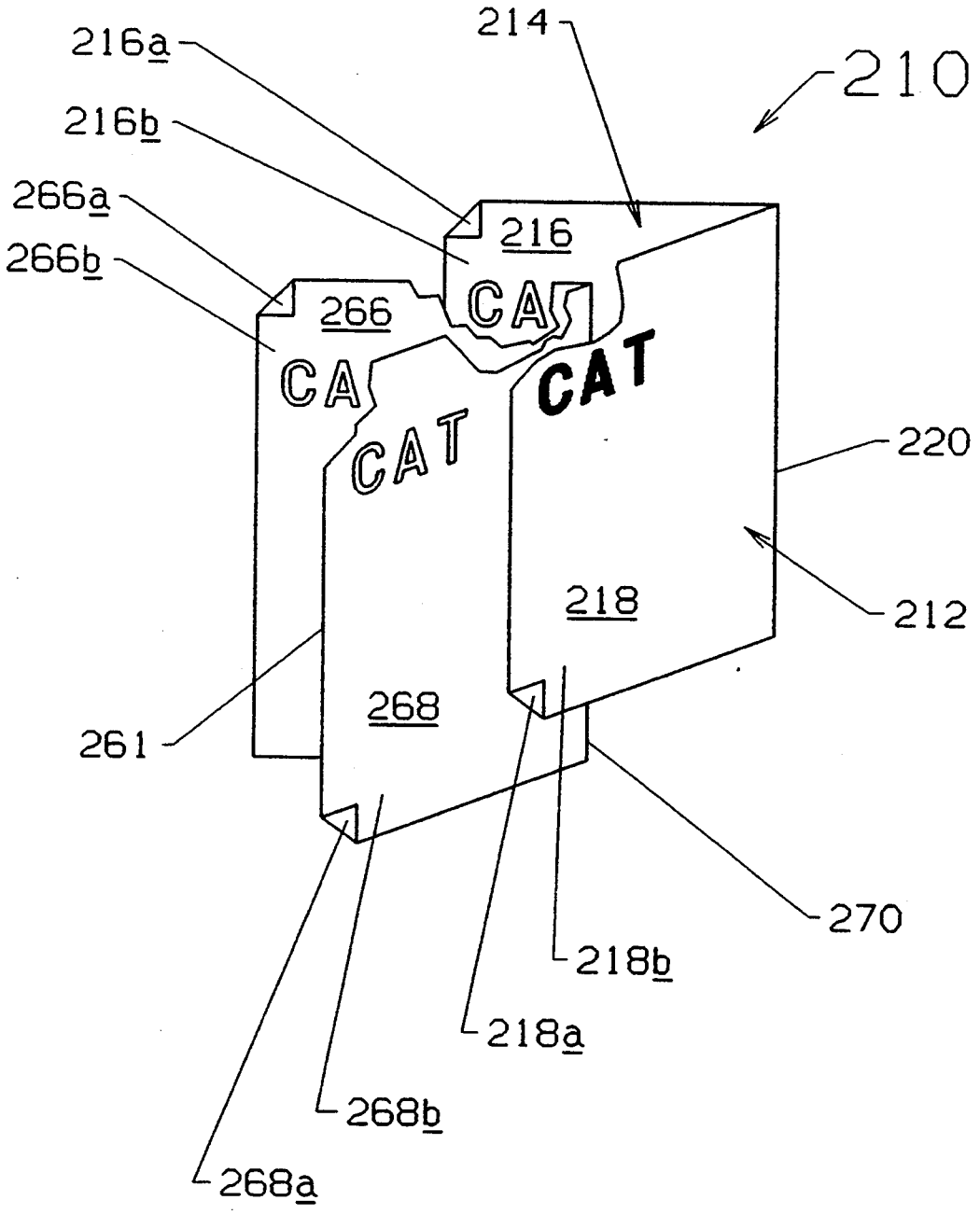
FIG. 2B is a perspective view of the form set of FIG. 2A, folded another way, for entering information on the opposite surface of the bottom-most copy panel.
Figure 2C:
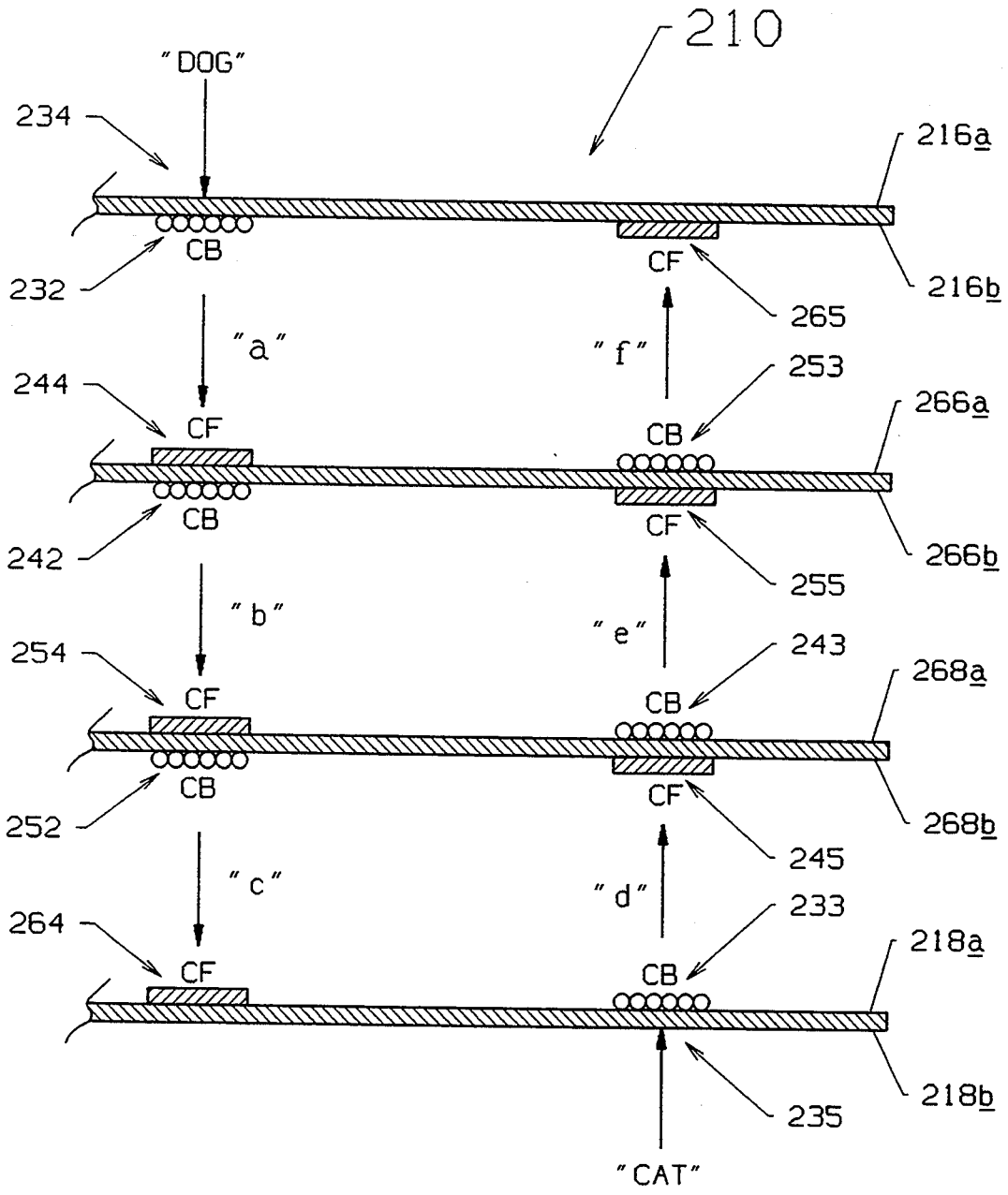
FIG. 2C is a cross-sectional view of the form set of FIGS. 2A and 2B, showing the carbonless coatings.

FIGS. 2A–2C show a form set 210 comprising two individual sheets 211 and 261.

A first sheet of paper 211 has a front surface 212 and a back surface 214. The sheet 211 is delineated into a "first" panel 216 and a "second" panel 218, preferably by a fold 220, and the fold 220 is preferably provided with a series of perforations (not shown) for aiding in folding and facilitating separating (after use) the two panels 216, 218.

A second sheet of paper 261 has a front surface 262 and a back surface 264. The sheet 261 is delineated into a "third" panel 266 and a "fourth" panel 268. The delineation in the second sheet 261 is preferably folded 270 and perforated in a manner similar to the first sheet. The panels 216, 218, 266 and 268 are all nominally the same size, e.g. measuring $8\frac{1}{2}\times 11$ inches. However, as disclosed in parent U.S. patent application Ser. No. 591,781 (Attorney Docket No. 90-138), the second panel 218 is advantageously slightly larger (e.g., wider) than the first panel 216.

In FIG. 2A, the sheet 211 is folded one way, and the sheet 261 is folded a corresponding one way, and the folded sheet 261 is inserted (nested) between the panels of the folded sheet 211. The Figure shows the sheet 261 being inserted between the panels of the sheet 211. With carbonless coatings appropriately disposed on the surfaces of the various panels, discussed below, information ("DOG") entered on one surface 216 of the first panel 216 ("DOG", in solid lettering) will be imaged onto a corresponding one surface 266*a* of the third panel 266 ("DOG", in outline lettering), will further be imaged onto a corresponding one surface 268*a* of the fourth panel 268 ("DOG", in outline lettering), and will yet further be imaged onto a corresponding one surface 218*a* of the second panel 218 ("DOG", in outline lettering). The second sheet 261 is fully inserted so that its fold 270 is "snugged up" against the fold 220 of the first sheet 211, to maintain proper alignment of the various panels.

In FIG. 2B, the sheets 211 and 261 remain folded and interleaved as in FIG. 2A, but together they are flipped over in their entirety so that the opposite surface 218*b* of the second panel 218 is exposed (up) for writing. With appropriate carbonless coatings, discussed below, information ("CAT") entered on the opposite surface 218*b* of the second panel 218 ("CAT", in solid lettering) will be imaged onto the corresponding opposite surface 268*b* of the fourth panel 268 ("CAT", in outline lettering), will further be imaged onto the corresponding opposite surface 266*b* of the third panel 266 ("CAT", in outline lettering), and will yet further be imaged onto the corresponding opposite surface 216*b* of the first panel 216 ("CAT", in outline lettering).

Hence, the first panel 216 has original first writing (DOG) on its one surface 216*a*, and duplicate first writing (CAT) imaged onto its opposite surface 216*b*. Similarly, the second panel 218 has original second writing (CAT) on its opposite surface 218*b*, and duplicate first writing (DOG) imaged onto its one surface 218*a*. The third and fourth panels of the second sheet 261 have duplicate first writing (DOG) imaged onto their one surfaces 266*a* and 268*a*, respectively, and have duplicate second writing (CAT) imaged onto their opposite surfaces 266*b* and 268*b*, respectively. These are the hallmarks of a "two-way rite" type system, in that none of the elements (in this case, panels—usually individual sheets) has original first and second writing on both sides (surfaces).

Before discussing how the various panels are carbonless coated, it should be noted that the front surface 212 of the sheet 211 comprises the one surface 216*a* of the first panel 216 and the contiguous opposite surface 218*b* of the second panel 218. Similarly, the back surface 214 of the sheet 211 comprises the opposite surface 216*b* of the first panel 216 and the contiguous one surface 218*a* of the second panel 218. Likewise, the front surface 262 of the sheet 261 comprises the one surface 266*a* of the third panel 266 and the contiguous opposite surface 268*b* of the fourth panel 268, and the back surface 264 of the sheet 261 comprises the opposite surface 266*b* of the third panel 266 and the contiguous one surface 268*a* of the fourth panel 268.

FIG. 2C shows how the various panels are carbonless coated to achieve the two-sided, self-replicating functions set forth above. The carbonless coating components are applied to selected areas ("patterning"), rather than to substantially the entire surface ("fully-coated") of a panel, and CB and CF components from a single carbonless system are employed.

A carbonless CB component is applied to a selected coating area 232 on the opposite surface 216*b* of the first panel 216 which is directly behind a selected writing area 234 on the one surface 216*a* of the first panel 216. A carbonless CF component is applied to a selected area 244 on the one surface 266*a* of the third panel 266, for revealing an image of first information ("DOG") entered upon the selected writing area 234. See arrow "a". The area 244 is aligned with the areas 234 and 232.

A carbonless CB component is applied to a selected coating area 242 on the opposite surface 266*b* of the third panel 266 which is directly behind the selected area 244. A carbonless CF component is applied to a selected area 254 on the one surface 268*a* of the fourth panel 268, for revealing an image of writing ("DOG") impressed upon the selected writing area 234. See arrow "b". The area 254 is aligned with the areas 234, 232, 244 and 242.

A carbonless CB component is applied to a selected coating area 252 on the opposite surface 268*b* of the fourth panel 268 which is directly behind the selected area 254. A carbonless CF component is applied to a selected area 264 on the one surface 218*a* of the second panel 218, for revealing an image of writing ("DOG") impressed upon the selected writing area 234. See arrow "c". The area 264 is aligned with the areas 234, 232, 244, 242, 254 and 252.

The selected areas 234, 232, 244, 242, 254, 252 and 264 comprise only a portion of the respective panel surfaces, and may be one contiguous area or a plurality of non-contiguous areas. As will be seen, the remaining areas on the surfaces of the panels are "reserved" for imaging in the opposite direction.

As mentioned above (FIGS. 2A and 2B), the sheets are not re-folded, nor are they re-inserted for entering second information ("CAT") on the opposite surface 218*b* of the second panel, and reproducing the second information on corresponding opposite surfaces of the fourth, third and first panels. Rather, they are simply re-oriented in their entirety, so that the opposite surface 218*b* of the second panel 218 is exposed for writing.

A carbonless CB component is applied to a selected coating area 233 on the one surface 218*a* of the second panel 218 which is directly behind a selected writing area 235 on the opposite surface 218*b* of the second panel 218. A carbonless CF component is applied to a selected coating area 245 on the opposite surface 268*b* of the fourth panel 268, for revealing an image of writing ("CAT") impressed upon the selected writing area 235. See arrow "d". The area 245 is aligned with the areas 235 and 233.

A carbonless CB component is applied to a selected coating area 243 on the one surface 268*a* of the fourth panel 268 which is directly behind the selected area 245. A carbonless CF component is applied to a selected area 255 on the opposite surface 266*b* of the third panel 266, for revealing an image of writing ("CAT") impressed upon the selected writing area 235. See arrow "e". The area 255 is aligned with the areas 235, 233, 245 and 243.

A carbonless CB component is applied to a selected coating area 253 on the one surface 266*a* of the third panel 266 which is directly behind the selected area 255. A carbonless CF component is applied to a selected area 265 on the opposite surface 216*b* of the first panel 216, for revealing an image of writing ("CAT") impressed upon the selected writing area 235. See arrow "f". The area 265 is aligned with the areas 235, 233, 245, 243, 255 and 253.

The first selected areas 234, 232, 244, 242, 254, 252 and 264 are offset from the second selected areas 235, 233, 245, 243, 255, 253 and 265.

Group 3

¢Two-Way-Write"—Single Sheet—One Copy

Figure 3A:
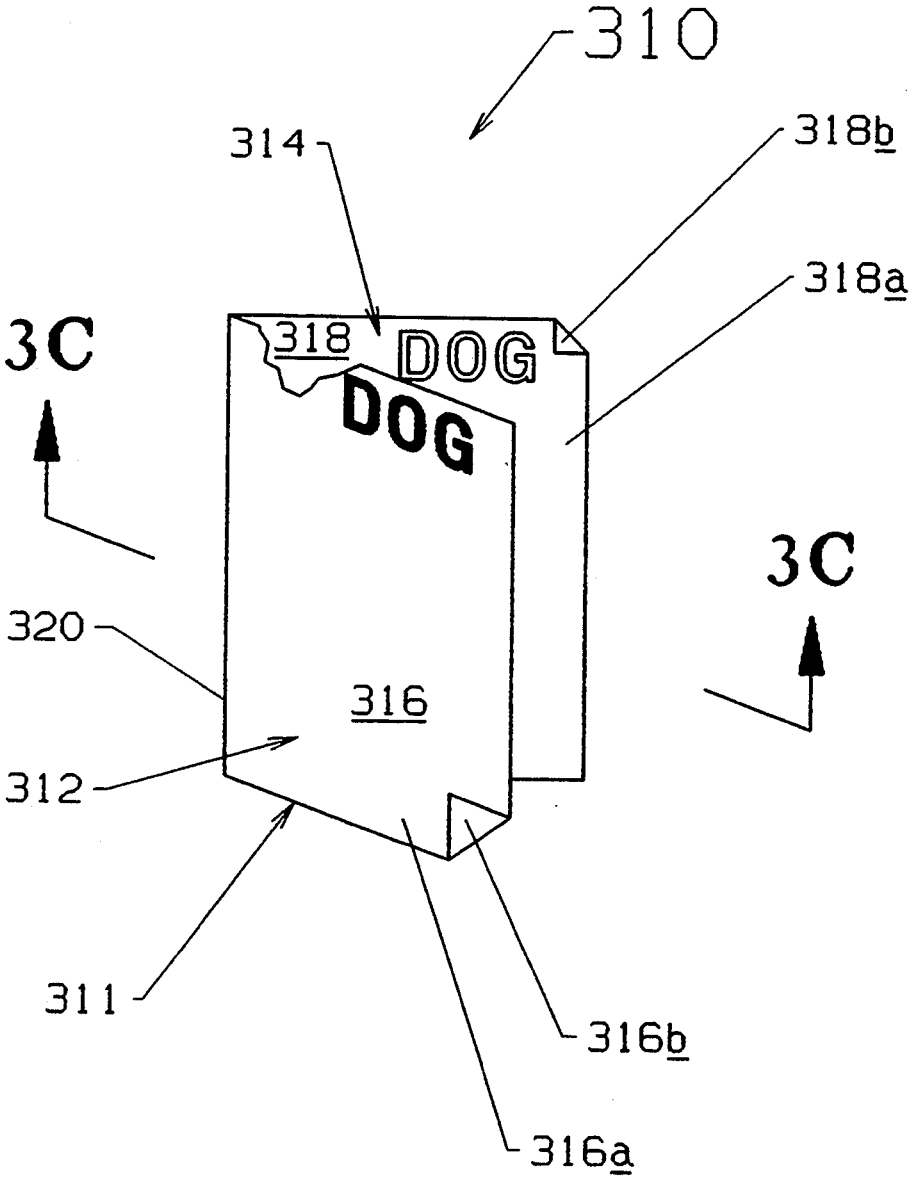
FIG. 3A is a perspective view of a "two-way-write" type, two-sided, self-replicating form, folded one way, for entering information on one surface of the original panel.
Figure 3B:
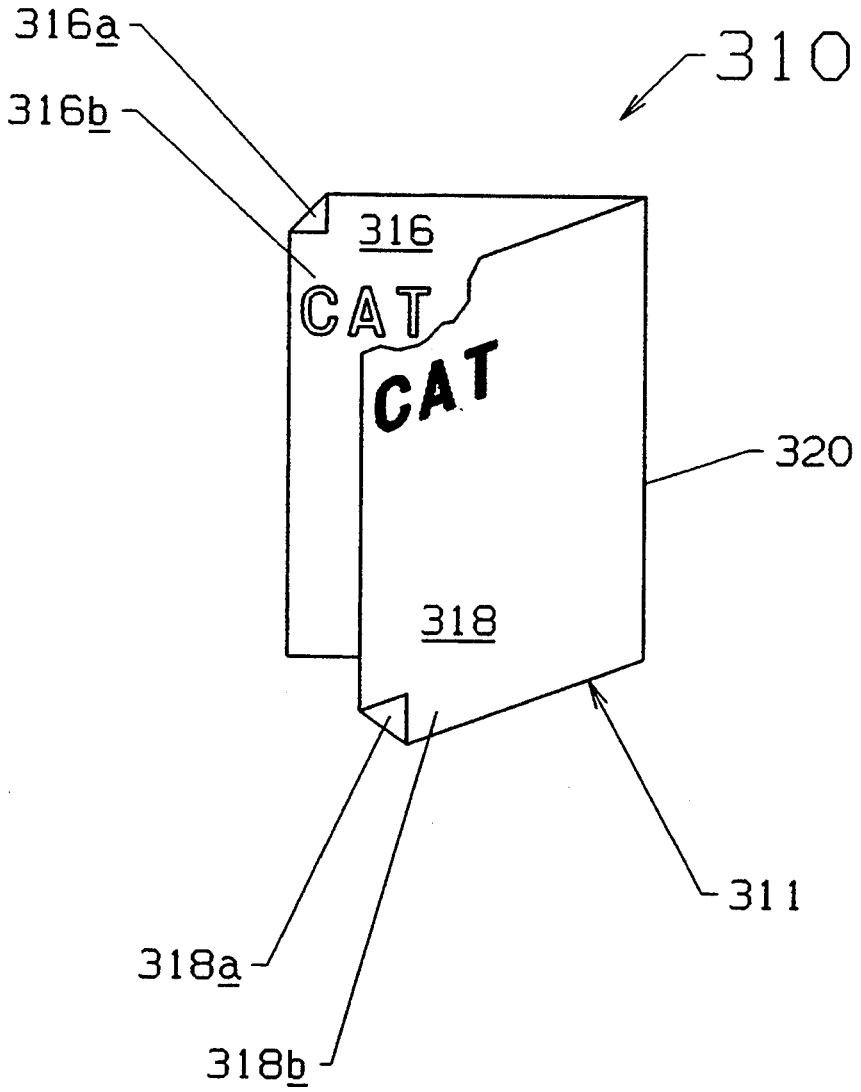
FIG. 3B is a perspective view of the form of FIG. 3A, folded another way, for entering information on the opposite surface of the copy panel.
Figure 3C:
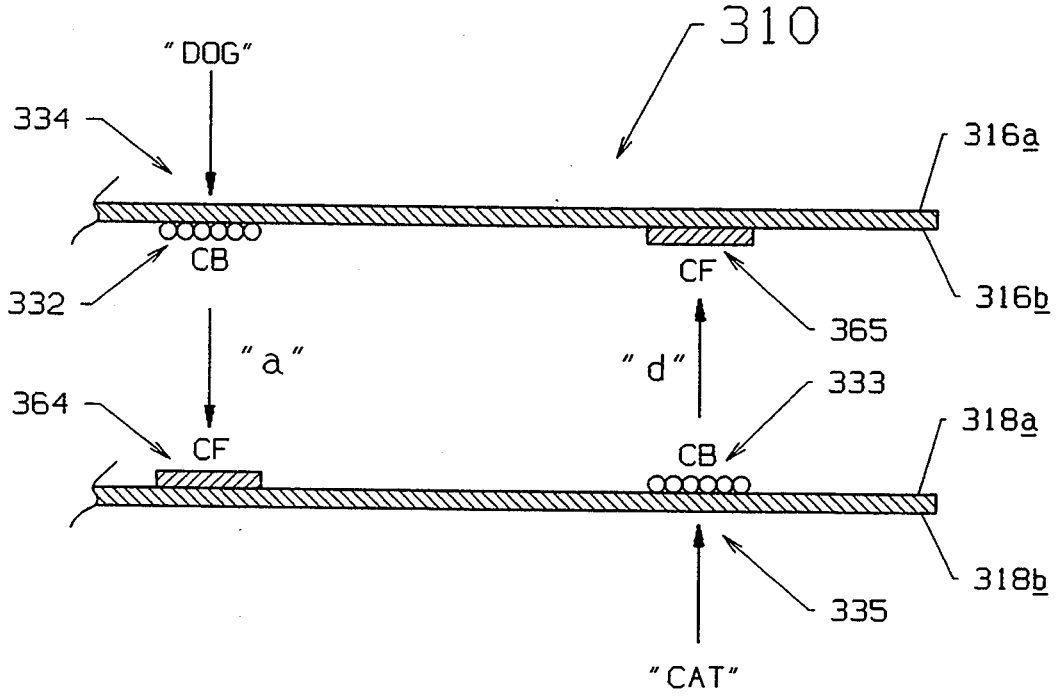
FIG. 3C is a cross-sectional view of the form set of FIGS. 3A and 3B, showing the carbonless coatings.

FIGS. 3A–3C illustrate a simpler two-way rite type form having only one single sheet of paper, folded to form two panels.

In essence, the sheet 211 of the previous embodiment is employed for this purpose.

A sheet of paper 311 has a front surface 312 and a back surface 314. The sheet 311 is delineated into a "first" panel 316 and a "second" panel 318, preferably by a fold 320, and the fold 320 is preferably provided with a series of perforations (not shown) for aiding in folding and facilitating separating (after use) the two panels 316, 318.

The panels 316 and 318 are nominally the same size, e.g. measuring $8\frac{1}{2} \times 11$ inches. However, as disclosed in parent U.S. patent application Ser. No. 591,781 (Attorney Docket No. 90-138), the fold 320 may be formed slightly off center so that the second panel 318 is slightly larger than the first panel 316.

In FIG. 3A, the sheet 311 is folded and is positioned in one orientation, so that information ("DOG") entered on the one surface 316*a* of the first panel 316 will be imaged onto the corresponding one surface 318*a* of the second panel 318.

In FIG. 3B, the sheet 311 remains folded as in FIG. 3A, and is re-positioned, so that information ("CAT") entered on the opposite surface 318*b* of the second panel 318 will be imaged (reproduced) onto the corresponding opposite surface 316*b* of the first panel 316.

Again, since neither of the panels 316 or 318 contain original information on both sides, the form 310 must be considered to be of the "two-way-write" genre.

FIG. 3C shows how the various panels are carbonless coated to achieve the two-sided, self-replicating functions set forth above. The carbonless coating components are applied to selected areas ("patterning"), rather than to substantially the entire surface of a panel ("fully-coated"), and CB and CF components from a single carbonless system are employed.

A carbonless CB component is applied to a selected coating area 332 on the opposite surface 316*b* of the first panel 316 which is directly behind a selected writing area 334 on the one surface 316*a* of the first panel 316. A carbonless CF component is applied to a selected area 364 on the one surface 318*a* of the second panel 318, for revealing an image of first information ("DOG") entered upon the selected writing area 334. See arrow "a". The area 364 is aligned with the areas 334 and 332.

The selected areas 334, 332 and 364 comprise only a portion of the respective panel surfaces, and may be one contiguous area or a plurality of non-contiguous areas. As will be seen, the remaining areas on the surfaces of the panels are "reserved" for imaging in the opposite direction.

As mentioned above (FIGS. 3A and 3B), the sheet is not re-folded for entering second information ("CAT") on the opposite surface 318*b* of the second panel, and reproducing the second information onto the corresponding opposite surfaces of the first panel. Rather, the sheet 311 is simply re-oriented in its entirety, so that the opposite surface 318*b* of the second panel 318 is exposed for writing.

A carbonless CB component is applied to a selected coating area 333 on the one surface 318*a* of the second panel 318 which is directly behind a selected writing area 335 on the opposite surface 318*b* of the second panel 318. A carbonless CF component is applied to a selected coating area 365 on the opposite surface 316*b* of the first panel 316, for revealing an image of writing ("CAT") impressed upon the selected writing area 335. See arrow "d". The area 365 is aligned with the areas 335 and 333.

The first selected areas 334, 332 and 364 are offset from the second selected areas 335, 333 and 365.

Group 4

Single Sheet, True-Original, Transfer-Onto-Plain-Paper

Figure 4A:
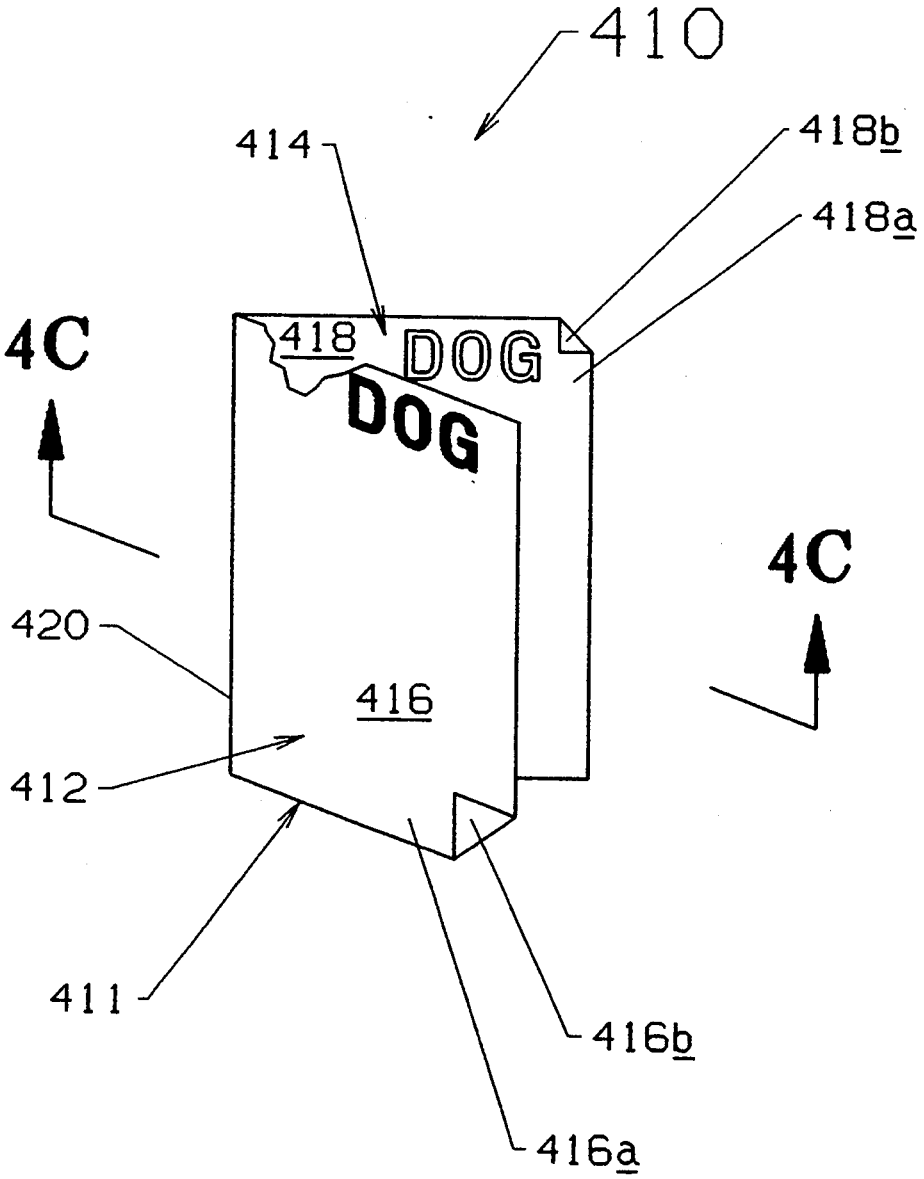
FIG. 4A is perspective view of a "true-original" type, two-sided, self-replicating form, folded one way, for entering information on one surface of the original panel.
Figure 4B:
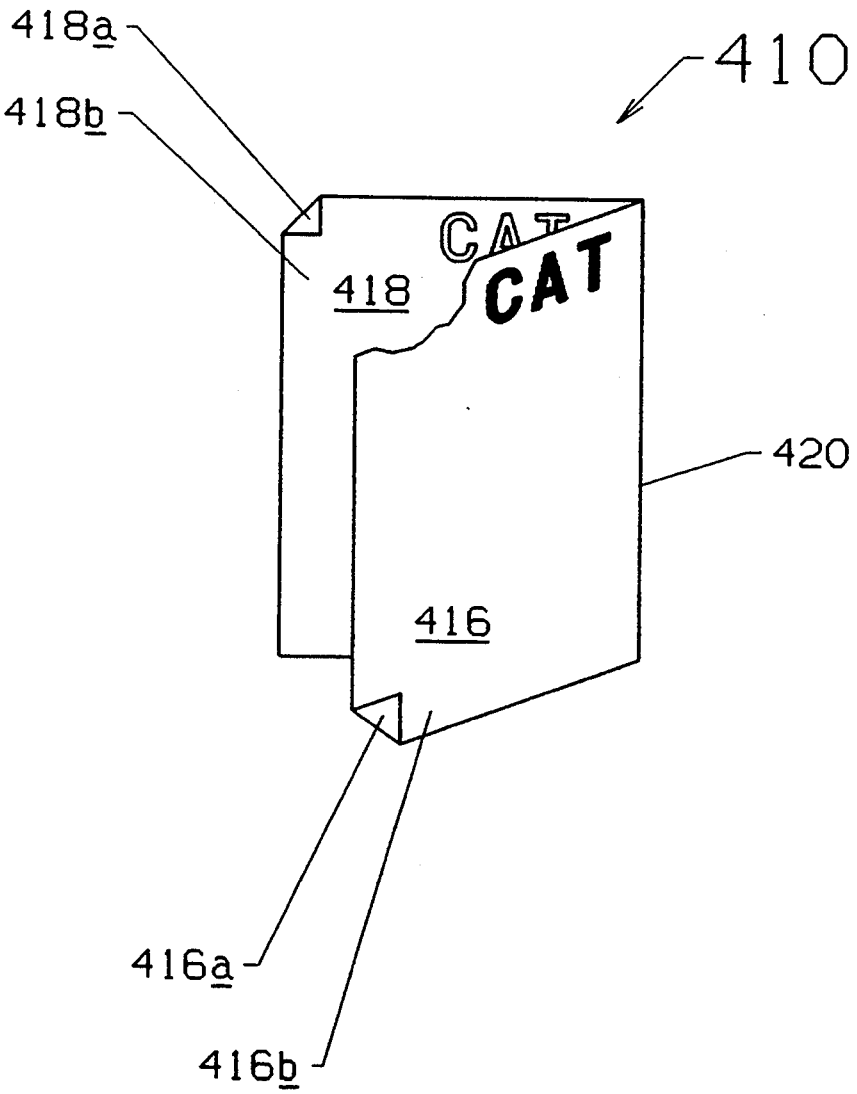
FIG. 4B is a perspective view of the form of FIG. 4A, folded another way, for entering information on the opposite surface of the original panel.
Figure 4C:
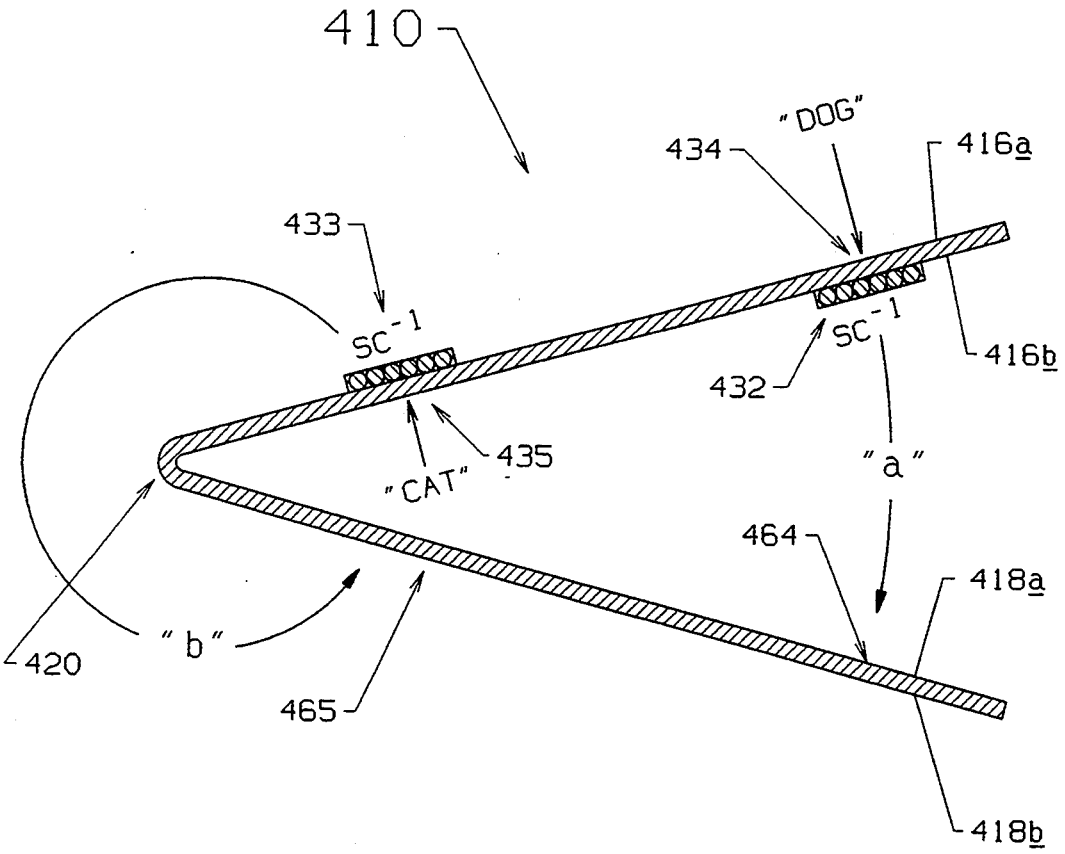
FIG. 4C is a cross-sectional view of the form set of FIGS. 4A and 4B, showing the carbonless coatings.

FIGS. 4A–4C illustrate a true-original type form 410, having only one single sheet of paper, folded to form two panels.

A single sheet of paper 411 has a front surface 412 and a back surface 414. The sheet 411 is delineated into an "original" panel 416 and a "copy" panel 418, preferably by a fold 420, and the fold 420 is preferably provided with a series of perforations (not shown) for aiding in folding and facilitating separating (after use) the two panels 416 and 418.

The panels 416 and 418 are nominally the same size, e.g. measuring $8\frac{1}{2}\times 11$ inches. However, as disclosed in parent U.S. patent application Ser. No. 591,781 (Attorney Docket No. 90-138), the fold 420 may be formed slightly off center so that the copy panel 418 is slightly larger than the original panel 416. This is advantageous when it comes to re-folding the sheet for entering second information ("CAT").

In FIG. 4A, the sheet 411 is folded one way, so that first information ("DOG") entered on the one surface 416*a* of the original panel 416 will be imaged onto the corresponding one surface 418*a* of the copy panel 418.

In FIG. 4B, the sheet 411 is folded in an opposite direction from that of FIG. 4A, exposing the opposite surface 416*b* of the original panel 416, so that second information ("CAT") entered on the opposite surface 416*b* of the original panel 416 will be imaged (reproduced) onto the corresponding opposite surface 418*b* of the copy panel 418.

Since the original panel 416 has original first and second information on its one and opposite surfaces, the form 400 must be considered to be of the "true-original" genre.

FIG. 4C shows how the various panels are carbonless coated to achieve the functions set forth above.

Reference is made to parent U.S. patent application Ser. No. 436,189 (Attorney Docket No. 89-109), wherein FIGS. 1L–1M illustrate using patterned self-contained (SC) carbonless coating on the copy panel (68'), and leaving the original panel (66') entirely uncoated.

Reference is also made to parent application Ser. No. 334,183 (Attorney Docket No. 88-126), wherein the sentence bridging pages 8–9 discloses "coating only the back surface of the original [panel]"—thereby postulating a "transfer-onto-plain-paper" type carbonless coating. U.S. Pat. No. 4,352,855 discloses such a "transfer-onto-plain-paper" type coating, hereinafter referred to as "anti-SC".

A carbonless anti-SC (or "$SC^{-1}$") coating is applied to a selected coating area 432 on the opposite surface 416*b* of the original panel 416 which is directly behind a selected writing area 434 on the one surface 416*a* of the original panel 416. A selected area 464 on the one surface 418*a* of the copy panel 418 is uncoated, and is aligned with the areas 434 and 432 (when the sheet 411 is folded one way), for revealing an image of writing ("DOG") impressed upon the selected writing area 434. See arrow "a". The selected areas 434, 432 and 464 may each comprise multiple discontiguous aligned areas on the respective surfaces of the panels.

The sheet 411 is then re-folded for entering second information ("CAT") on the opposite surface 416*b* of the original panel 416, and creating a carbonless copy of that information on the opposite surface 418*b* of the copy panel.

A carbonless anti-SC (or "$SC^{-1}$") coating is applied to a selected coating area 433 on the one surface 416*a* of the original panel 416 which is directly behind a selected writing area 435 on the opposite surface 416*b* of the original panel 416. A selected area 465 on the opposite surface 418*b* of the copy panel 418 is uncoated, and is aligned with the areas 435 and 433 (when the sheet 411 is folded the opposite way), for revealing an image of writing ("CAT") impressed upon the selected writing area 435. See arrow "b". The selected areas 435, 433 and 465 may each comprise multiple discontiguous aligned areas on the respective surfaces of the panels.

The first selected areas 434, 432 and 464 are offset from the second selected areas 435, 433 and 465.

Group 5

Two Color Imaging, True-Original

Figure 5A:
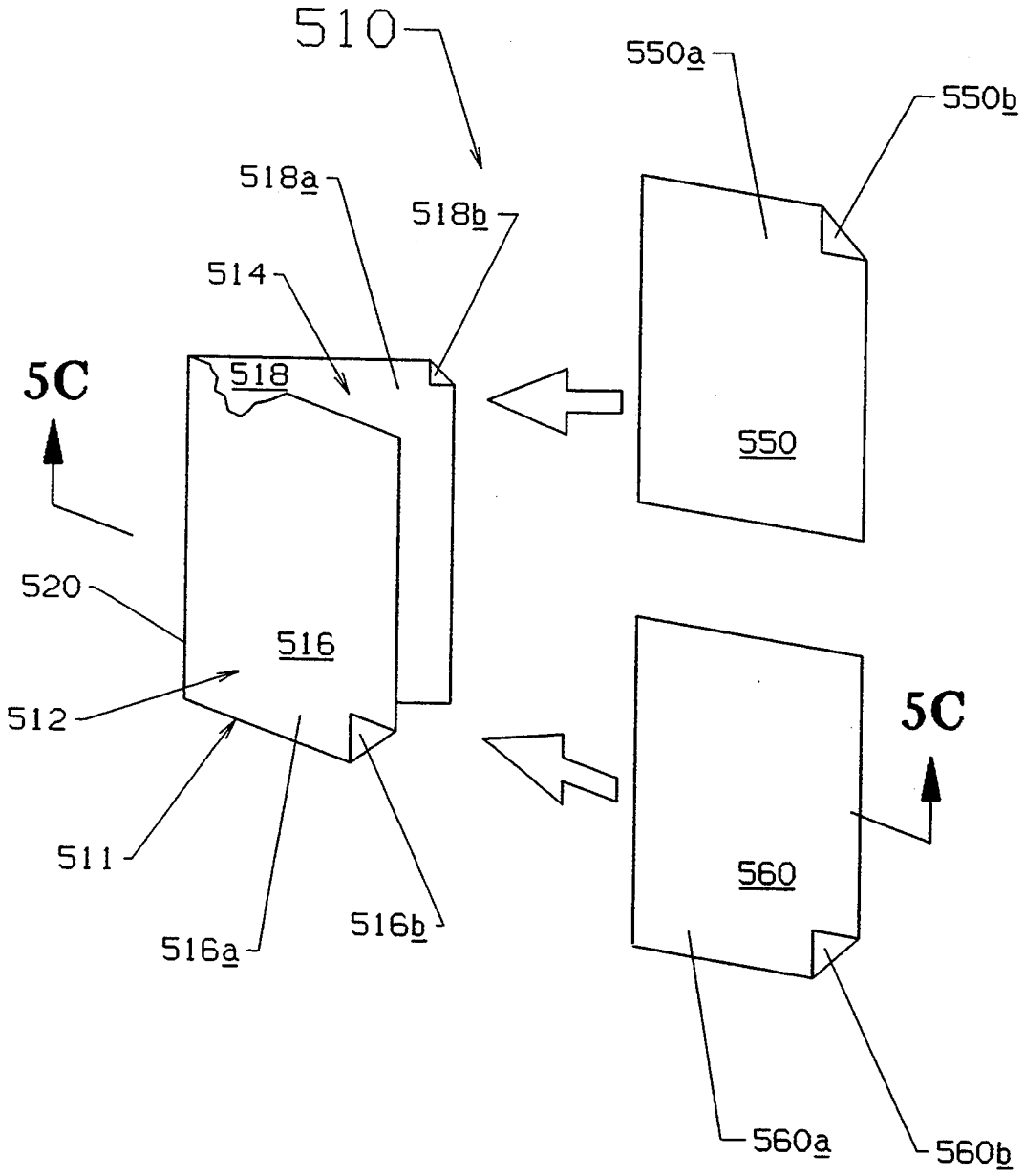
FIG. 5A is a perspective view of a "true-original" type two-sided, self-replicating form, with a single sheet having an original panel and a copy panel folded one way, for entering information on one surface of the original panel. Separate image-transferring sheets are also shown.
Figure 5B:
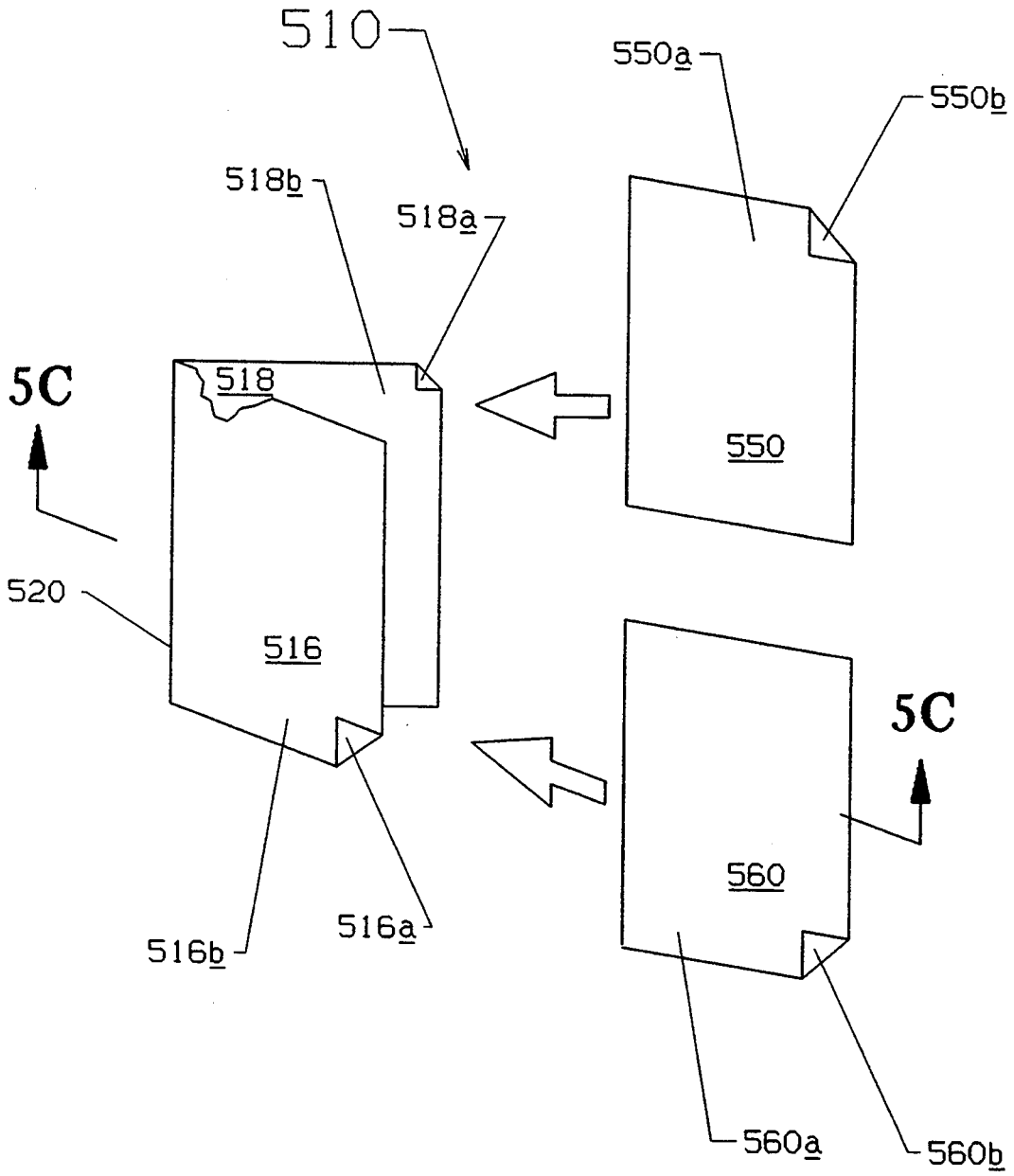
FIG. 5B is a perspective view of the form of FIG. 5A, folded another way, for entering information on the opposite surface of the original panel.
Figure 5C:
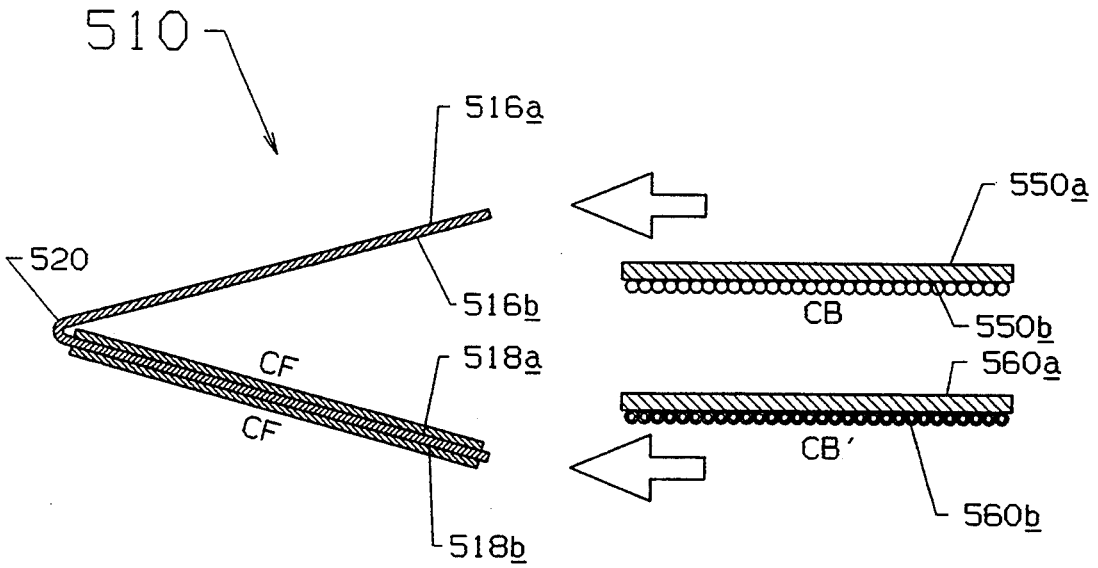
FIG. 5C is a cross-sectional view of the form of FIGS. 5A and 5B, showing the carbonless coatings.

FIGS. 5A–5C illustrate a true-original type form 500, having mainly only a single sheet of paper, folded to form two panels, an "original" panel 516 and a "copy" panel 518.

Attention is directed to parent U.S. patent application Ser. No. 484,686 (Attorney Docket No. 90-128), continued as U.S. patent application Ser. No. 723,690 (Attorney Docket No. 90-128-1), which discloses in FIGS. 2A–2C that the original panel (216) is not coated, the copy panel (218) is coated on both sides with CF, and a separate image-transferring sheet (250) coated on at least one side with CB is interposed between the panels to effect image-transfer between the original panel and the copy panel.

An advantage of the form disclosed in the parent application is that there are no coatings, hence no potential pen-skipping problems associated with writing on the original panel. While patterning the coatings also avoids this problem, patterning imposes its own constraints on the manufacture and limitations on the use of carbonless forms.

The present invention is very similar to the forms previously disclosed, with the exception that the user can select from at least two different image-transferring sheets to cause different color imaging on the copy panel. For example, it may be desirable in some circumstances to have the copy images reveal themselves in a blue color on one or both sides (surfaces) of the copy panel, and in other circumstances to reveal themselves in a black color on one or both sides (surfaces) of the copy panel. Blue and black are well known carbonless image-revealing colors.

With reference to FIGS. 5A–5C, a single sheet of paper 511 has a front surface 512 and a back surface 514. The sheet 511 is delineated into an "original" panel 516 and a "copy" panel 518, preferably by a fold 520, and the fold 520 is preferably provided with a series of perforations (not shown) for aiding in folding and facilitating separating (after use) the two panels 516 and 518.

The panels 516 and 518 are nominally the same size, e.g. measuring $8\frac{1}{2} \times 11$ inches. However, as disclosed in parent U.S. patent application Ser. No. 591,781 (Attorney Docket No. 90-138), the fold 520 may be formed slightly off center so that the copy panel 518 is slightly larger (e.g., wider) than the original panel 516. This is advantageous when it comes to re-folding the sheet for entering second information ("CAT") on the previously non-exposed surface (i.e., **516*b***) of the original panel.

In FIG. 5A, the sheet 511 is folded one way, so that first information ("DOG") entered on the one surface **516*a* of the original panel 516 will be imaged onto the corresponding one surface 518*a* of the copy panel 518**.

In FIG. 5B, the sheet 511 is folded in an opposite direction from that of FIG. 5A, exposing the opposite surface **516*b* of the original panel 516, so that second information ("CAT") entered on the opposite surface 516*b* of the original panel 516 will be imaged (reproduced) onto the corresponding opposite surface 518*b* of the copy panel 518**.

One of two separate image-transferring sheets 550 or 560 is interposed between the original and copy panels, when folded either way, to effect image-transferring, and may be discarded after use.

Since the original panel 516 has original first and second information on its one and opposite surfaces, the form 500 must be considered to be of the "true-original" genre.

FIG. 5C shows how the sheet 511 and sheets 550/560 are carbonless coated to achieve the functions set forth above.

The inventors have realized that various CB coatings will cause various color images on a specific CF coating. For example, waxy OPAS (from MEAD) CB images blue on black "PRT" (mill stock) CF coated stock, and aqueous OPAS ("LCB", from MEAD) images black on the same PRT stock. Other combinations of coatings from various manufacturers have been found to exhibit this characteristic.

According to the invention, a single "standard" sheet 511 is employed, and the user is free to select from at least two different image-transferring sheets 550 or 560 to exercise control over the color of the images on the copy panel 518. The inventors envision that a blue or a black imaging CB image-transferring sheet would be used for imaging onto both sides of the copy panel, but a user may also use a blue-imaging CB image-transferring sheet 550 the one way ("DOG") and a black-imaging CB image-transferring sheet 550' the other way ("CAT"), or vice-versa. In this case, the user would want both color image-transferring sheets 550 and 560 on hand. They could easily be distinguished by color-coding, or other appropriate distinguishing marks. To this end, it is proposed that a blue-imaging image-transferring sheet be colored blue, and that a black-imaging image transferring sheet be colored grey (i.e., a light shade of black). In either case, the image-transferring sheet preferably would be dissimilarly colored from the usual white original and pink or canary copy.

As shown in FIG. 5C, the original panel 516 is uncoated (i.e., does not have either component of a carbonless system). The copy panel 518 is coated on both sides **518*a* and 518*b*** with a CF component capable of revealing an image in at least two visibly different colors, depending upon the particular CB employed.

The image-transferring sheet 550 is coated on at least one side **550*b* with a carbonless CB component revealing itself on the CF-coated copy panel 518** in one color (e.g., blue). It can be also coated on both sides with the same CB component.

The image-transferring sheet 560 is coated on at least one side **560*b* with a carbonless CB' component revealing itself on the CF-coated copy panel 518** in another, dissimilar color (e.g., black). It can be also coated on both sides with the same CB' component.

As set forth above, the user would select from one of the sheets 550, 560 for imaging in one direction ("DOG"), and would select the same or the other sheet for imaging in the opposite direction ("CAT"). Since, whichever way the sheet 511 is folded, only the down-facing surface of the image-transferring sheet 550 or 560 is operative, as mentioned above, the up-facing surface can be coated with the same component as the down-facing surface.

Figure 5D:
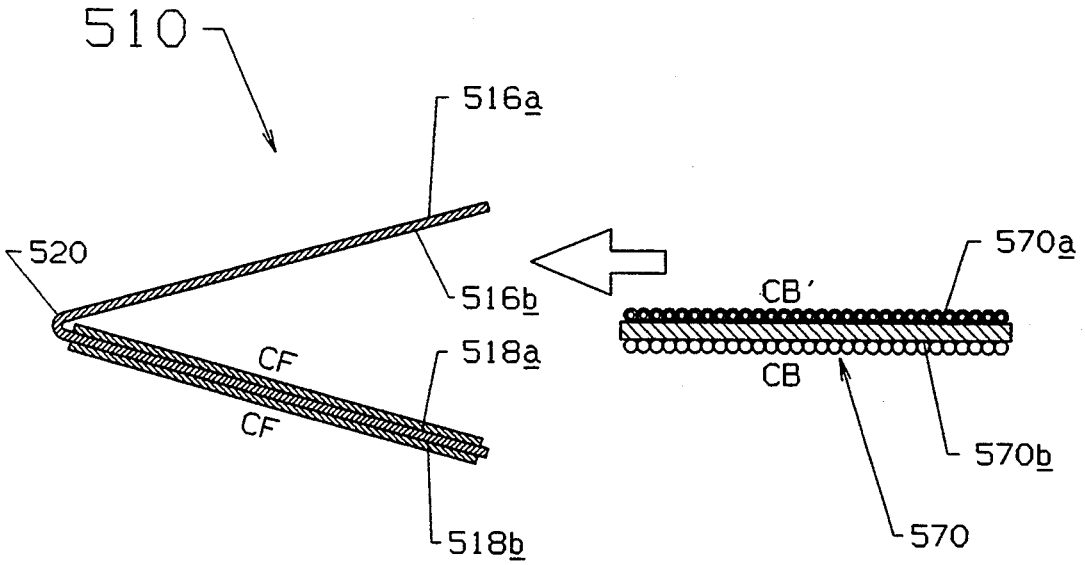
FIG. 5D is a cross-sectional view of an alternate embodiment of the form of FIGS. 5A–5C, wherein only a single image-transferring sheet capable of image-transferring in one of two colors is employed.

With reference to FIG. 5D, a single intermediate transfer sheet 570 can advantageously be coated with a CB component revealing itself in one color on one side 570*b*, and with a CB′ component revealing itself in another dissimilar color on another side 570*a*. With such a single image-transferring sheet (rather than two different sheets 550, 560), the user would simply select which surface of the intermediate transfer sheet 570 is facing down when it is inserted between the folded ("DOG") and re-folded ("CAT") sheet 511 to exercise control over the color in which writing is reproduced.

What is claimed is:

1. A carbonless form, consisting essentially of:

a single sheet delineated into two panels—a first panel and a second panel;

each of the panels having corresponding one surfaces and corresponding opposite surfaces;

carbonless coatings applied to the various panels, so that writing on the one surface of the first panel is reproduced onto the corresponding one surface of the second panel when the sheets is folded one way; and carbonless coatings applied to the various panels, so that writing on the opposite surface of the second panel is reproduced onto the corresponding opposite surface of the first panel when the sheet remains folded the one way.

2. A carbonless form, according to claim 1, wherein:

the one surface of the first panel is provided with at least one selected first writing area for entering first information;

the opposite surface of the first panel is coated with a CB image-transferring component in at least one selected area aligned with the at least one selected first writing area;

the one surface of the second panel is coated with a CF image-revealing component in at least one selected area aligned with the at least one selected first writing area;

the opposite surface of the second panel is provided with at least one selected second writing area, offset from the at least one selected first writing area, for entering second information;

the one surface of the second panel is coated with a CB image-transferring component in at least one selected area aligned with the at least one selected second writing area; and the opposite surface of the first panel is coated with a CF image-revealing component in at least one selected area aligned with the second writing area.

3. A single sheet, two-way-write type form, comprising:

a single sheet of paper delineated into a one panel and an other panel;

a one side of the one panel clear of carbonless coatings;

an opposite side of the one panel provided with both CB and CF carbonless coatings;

a one side of the other panel provided with both CF and CB carbonless coatings; and an opposite side of the other panel clear of carbonless coatings.

4. A single sheet, two-way-write type form, according to claim 3, wherein:

the CB coating on the opposite side of the one panel is aligned with the CF coating on the one side of the other panel, when the single sheet is folded.

5. A single sheet, two-way-write type form, according to claim 3, wherein:

the CF coating on the opposite side of the one panel is aligned with the CB coating on the one side of the other panel, when the single sheet is folded.

6. A single sheet, two-way-write type form, according to claim 3, wherein:

the CB coating on the opposite side of the one panel is applied in a first selected area which is offset from a second selected area where the CF coating is applied on the opposite side of the one panel.

7. A single sheet, two-way-write type form, according to claim 3, wherein:

the CF coating on the one side of the other panel is applied in a first selected area which is offset from a second selected area where the CB coating is applied on the one side of the other panel.

8. A single sheet, two-way-write type form, according to claim 3, wherein:

the CB coating on the opposite side of the one panel is applied in a first selected area which is offset from a second selected area where the CF coating is applied on the opposite side of the one panel;

the CF coating on the one side of the other panel is applied in a third selected area which is offset from a fourth selected area where the CB coating is applied on the one side of the other panel; and the third selected area is aligned with the first selected area, and the fourth selected area is aligned with the second selected area when the form is folded.

9. A single sheet, two-way-write type form, according to claim 3, wherein:

when the sheet is folded so that the opposite side of the one panel is contacting the one side of the other panel, the carbonless coatings are aligned so that writing on the one side of the one panel is reproduced on the one side of the other panel; and writing on the opposite side of the other panel is reproduced on the opposite side of the one panel.

10. Carbonless form, comprising:

a single sheet of paper delineated into two panels, a one panel and an other panel;

each of the panels having both carbonless CB and carbonless CF coatings on a one side and clear of carbonless coatings on an opposite side.

11. Carbonless form, according to claim 10, wherein:

the CB coating on the one side of the one panel is aligned with the CF coating on the one side of the other panel, when the single sheet is folded.

12. Carbonless form, according to claim 10, wherein:

the CF coating on the one side of the one panel is aligned with the CB coating on the one side of the other panel, when the single sheet is folded.

13. Carbonless form, according to claim 10, wherein:

the CB coating on the one side of the one panel is applied in a first selected area which is offset from a second selected area where the CF coating is applied on the one side of the one panel.

14. Carbonless form, according to claim 10, wherein:

the CF coating on the one side of the other panel is applied in a third selected area which is offset from a fourth selected area where the CB coating is applied on the one side of the other panel.

15. Carbonless form, according to claim 10, wherein:

the CB coating on the one side of the one panel is applied in a first selected area which is offset from a second selected area where the CF coating is applied on the one side of the one panel;

the CF coating on the one side of the other panel is applied in a third selected area which is offset from a fourth selected area where the CB coating is applied on the one side of the other panel; and the third selected area is aligned with the first selected area, and the fourth selected area is aligned with the second selected area when the form is folded.

16. Carbonless form, according to claim 10, wherein:

writing on the opposite side of the one panel is reproduced on the one side of the other panel; and writing on the opposite side of the other panel is reproduced on the one side of the one panel.

* * * * *